US010047509B2

(12) United States Patent
Schuster et al.

(10) Patent No.: US 10,047,509 B2
(45) Date of Patent: Aug. 14, 2018

(54) DUAL FLUSH ACTIVATION

(75) Inventors: Michael J. Schuster, Joliet, IL (US); Douglas C. Saunders, Plainfield, IL (US); Duston E. A. Stutzman, Plainfield, IL (US)

(73) Assignee: Danco, Inc., Irving, TX (US)

( * ) Notice: Subject to any disclaimer, the term of this patent is extended or adjusted under 35 U.S.C. 154(b) by 2331 days.

(21) Appl. No.: 12/986,729

(22) Filed: Jan. 7, 2011

(65) Prior Publication Data

US 2011/0167549 A1 Jul. 14, 2011

Related U.S. Application Data

(60) Provisional application No. 61/293,343, filed on Jan. 8, 2010, provisional application No. 61/331,147, filed on May 4, 2010, provisional application No. 61/331,213, filed on May 4, 2010.

(51) Int. Cl.

| | |
|---|---|
| ***E03D 5/00*** | (2006.01) |
| ***E03D 5/09*** | (2006.01) |
| ***E03D 1/14*** | (2006.01) |

(52) U.S. Cl.

CPC ..... *E03D 5/09* (2013.01); *E03D 1/142* (2013.01); *Y10T 29/49716* (2015.01)

(58) Field of Classification Search

USPC ..... 4/405, 410, 324

See application file for complete search history.

(56) References Cited

U.S. PATENT DOCUMENTS

| | | | | | |
|---|---|---|---|---|---|
| 3,345,649 | A | * | 10/1967 | Cabra | 4/410 |
| 4,530,119 | A | * | 7/1985 | Chiu et al. | 4/324 |
| 4,733,416 | A | * | 3/1988 | Ott | 4/410 |
| 4,969,218 | A | * | 11/1990 | Comparetti | 4/325 |
| 5,659,903 | A | * | 8/1997 | Hammarstedt | 4/325 |
| 6,163,897 | A | * | 12/2000 | Plas et al. | 4/410 |

* cited by examiner

*Primary Examiner* — Lauren Crane

(74) *Attorney, Agent, or Firm* — Thomas| Horstemeyer, LLP

(57) ABSTRACT

Various methods and systems are provided for dual flush activation. In one embodiment, an assembly includes a handle assembly; and a transfer box configured to detachably connect to an actuation control box of the dual flush toilet system. The transfer box is configured to translate a rotational motion of the handle assembly into a linear motion accepted by the actuation control box to initiate a flush mode of the dual flush toilet system. In another embodiment, an assembly includes a dual-input actuation control box configured to detachably connect to a rotary handle assembly and a push button assembly. The dual-input transfer box is configured to translate a rotational motion of the rotary handle assembly and a liner motion of the push button assembly into a linear motion to initiate a flush mode of the dual flush toilet system.

17 Claims, 30 Drawing Sheets

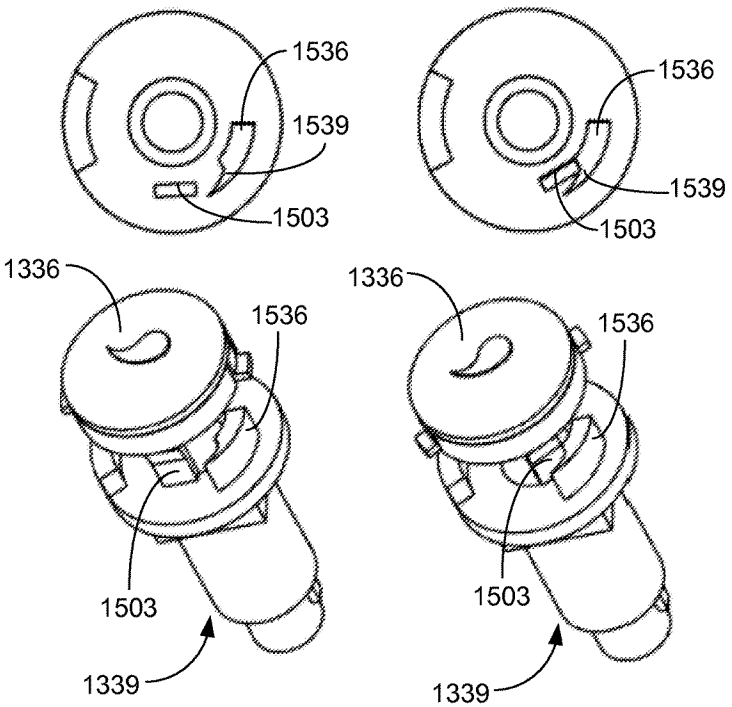
FIG. 12G
FIG. 12F
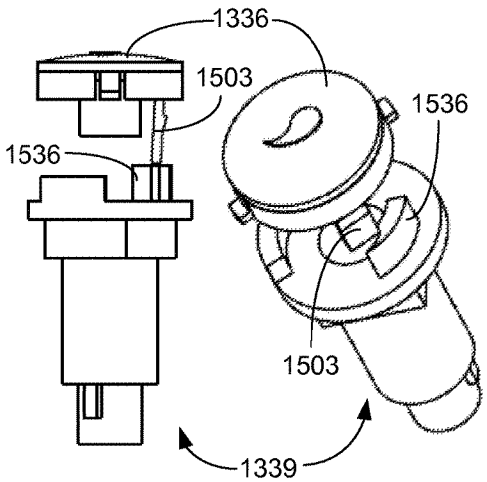
FIG. 12E

DUAL FLUSH ACTIVATION

CROSS REFERENCE TO RELATED APPLICATIONS

This application claims priority to U.S. provisional application entitled "DUAL FLUSH TOILET HANDLE CONVERTER" having Ser. No. 61/293,343, filed Jan. 8, 2010, U.S. provisional application entitled "DUAL FLUSH ACTIVATION ASSEMBLY" having Ser. No. 61/331,147, filed May 4, 2010, and U.S. provisional application entitled "DUAL FLUSH CABLE ANCHOR ASSEMBLY" having Ser. No. 61/331,213, filed May 4, 2010, wherein the entirety of each provisional application is hereby incorporated by reference.

BACKGROUND

Most dual flush toilet systems are provided as a package including a dual flush assembly and an activation device to initiate operation of the dual flush assembly in one of the dual flush modes. In many instances, the activation device may not be preferred by the customer. In some instances, it is desirable to convert a handle of the activation device without the significant effort needed to replace or modify the dual flush toilet system.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

FIGS. 12A-12G are drawings that provide various views of a rotary handle converter assembly of FIG. 10 according to various embodiments of the disclosure.

DETAILED DESCRIPTION

Figure 1:
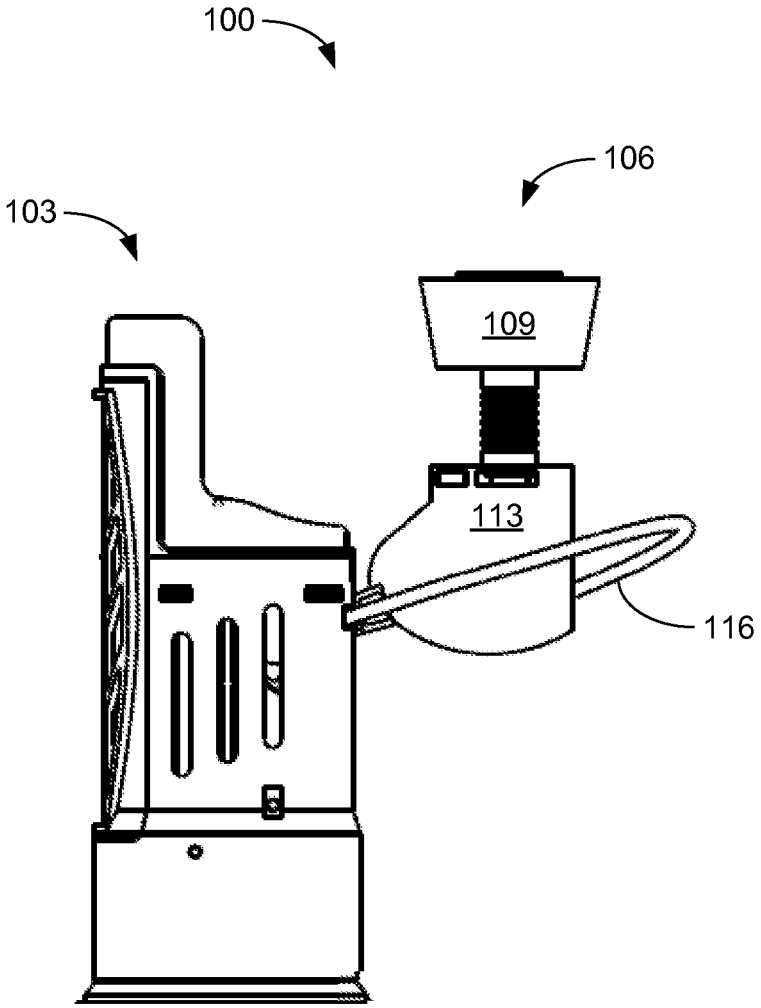
FIG. 1 is a drawing of a dual flush toilet system with push button activation.

With reference to FIG. 1, shown is a dual flush toilet system 100 including a dual flush assembly 103 and an activation assembly 106 to initiate operation of the dual flush assembly 103 in one of the dual flush modes: quick flush for liquids and full flush for solids. In the embodiment of FIG. 1, the activation assembly 106 includes a push button handle 109 that is detachably connected to an actuation control box 113. The actuation control box 113 is in communication with the dual flush assembly 103 through a cable assembly 116, which is directly connected to the actuation control box 113 and the body of the dual flush assembly 103.

Referring next to FIGS. 2A-F, the operation of the activation assembly 106 is illustrated. The push button assembly 109 is detachably connected to the actuation control box 113 through a shaft extension 203, which is threaded to mount the push button assembly 109 to the tank of the toilet with a nut. In the embodiment of FIGS. 2A-F, the end 206 of the shaft extension 203 is engaged with the actuation control box 113 by a spring-loaded clip assembly 209. By pressing the end of clip assembly 209, the push button assembly 109 may be detached from the actuation control box 113. The push button assembly 109 includes a first button 213 for activation of the quick flush mode with a reduced amount of water usage and a second button 216 for activation of the full flush mode using the standard amount of water.

Figure 2A:
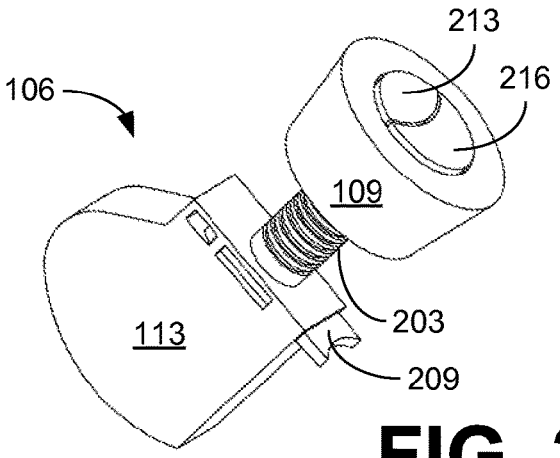
FIGS. 2A-2F are drawings that provide various views of an activation assembly for push button activation of the dual flush toilet system of FIG. 1.
Figure 2B:
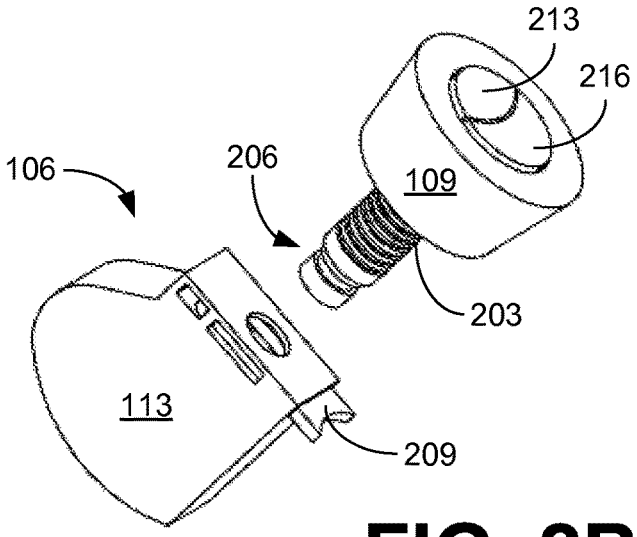
Figure 2C:
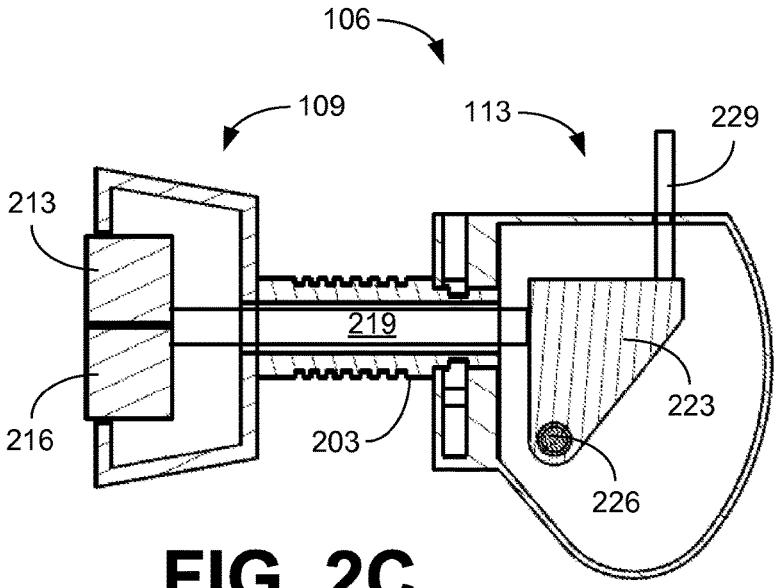
Figure 2D:
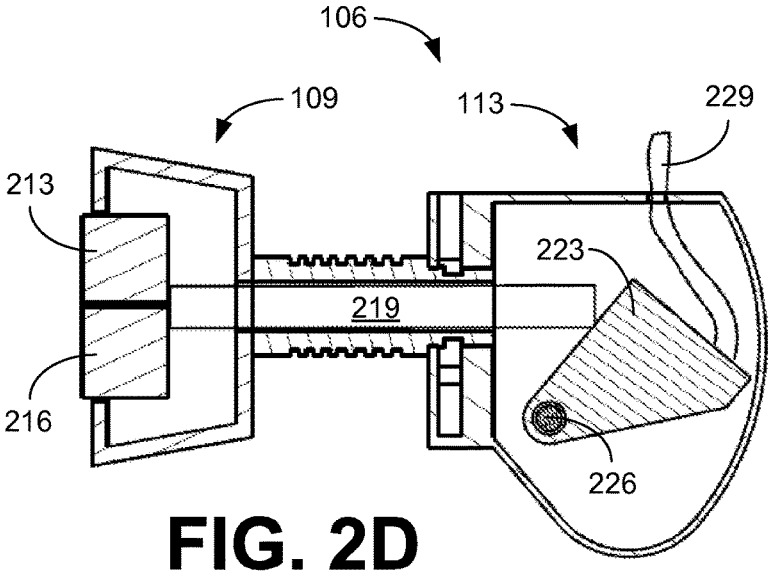
Figure 2E:
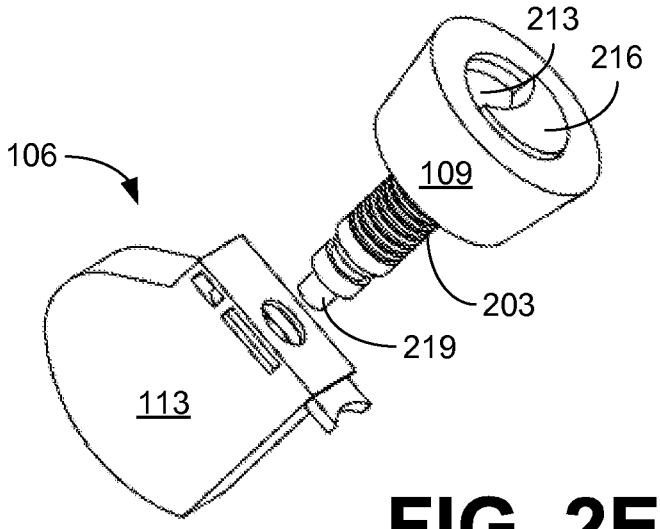
Figure 2F:
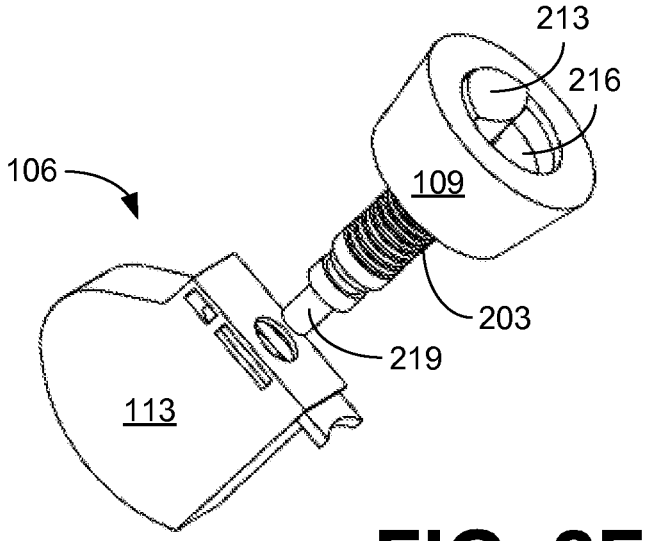

FIG. 2C illustrates a cross-sectional view of the activation assembly 106 of FIG. 2A. FIGS. 2A and 2C show the actuation control box 113 in a neutral position without buttons 213 or 216 depressed. Depressing one of the buttons 213 or 216 extends a plunger 219 from the end of the shaft extension 203 into the actuation control box 113. In the exemplary embodiment of FIGS. 2C-D, extension of plunger 219 causes a cam 223 to rotate about a fixed point 226, retracting a cable 229 in cable assembly 116 of FIG. 1. In this way, linear motion of the plunger 219 is converted into linear motion of cable 229 in cable assembly 116. Depressing the first "quick flush" button 213 extends the plunger 219 to a predetermined intermediate position as illustrated in FIG. 2E, while depressing the second "full flush" button 216 fully extends the plunger 219 as depicted in FIGS. 2B and 2F. When the plunger 219 is retracted after the desired flush is initiated, cam 223 and cable 229 return to the neutral position depicted in FIG. 2C.

Figure 3:
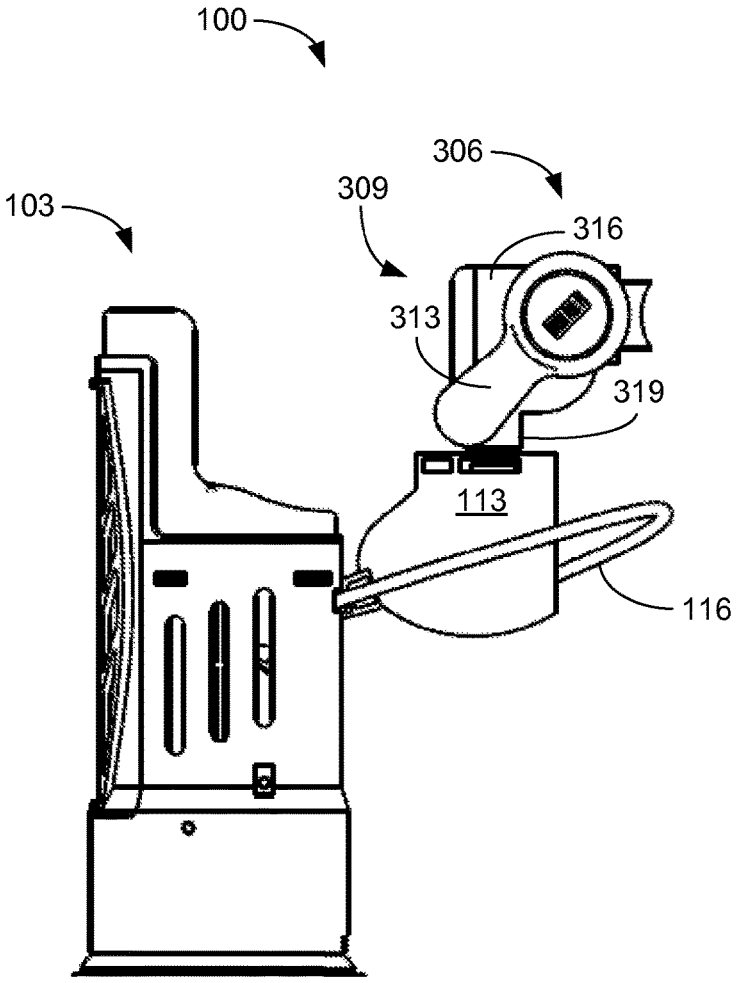
FIG. 3 is a drawing of the dual flush toilet system of FIG. 1 including a handle converter assembly according to various embodiments of the disclosure.

With reference to FIG. 3, shown is the dual flush toilet system 100 including a dual flush assembly 103 and an activation assembly 306 including a handle converter assembly 309 detachably connected to actuation control box 113. The handle converter assembly 309 includes a handle assembly 313 in communication with a transfer box 316. The transfer box 316 is detachably connected to the actuation control box 113 through a mounting extension 319 in a fashion similar to the actuation control box 113 of FIGS. 2A-F.

With reference next to FIGS. 4A-G, the handle assembly 313 includes a handle lever 403, a handle button 406, and a mounting sleeve 409 through which the shaft of the handle lever 403 extends. The handle assembly 313 is detachably connected to transfer box 316. In the embodiment of FIGS.

4A-G, the end of the mounting sleeve 409 is engaged with the transfer box 316 by a spring-loaded clip assembly 413.

Figure 4A:
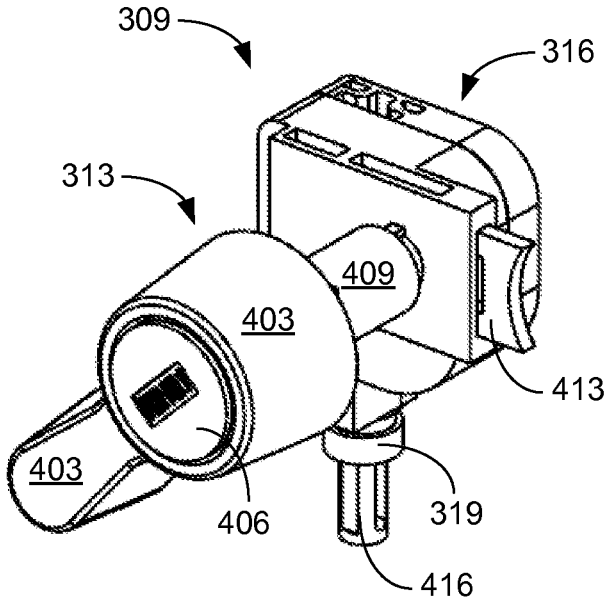
FIGS. 4A-4G and 5A-5D are drawings that provide various views of the handle converter assembly of FIG. 3 according to various embodiments of the disclosure.
Figure 4B:
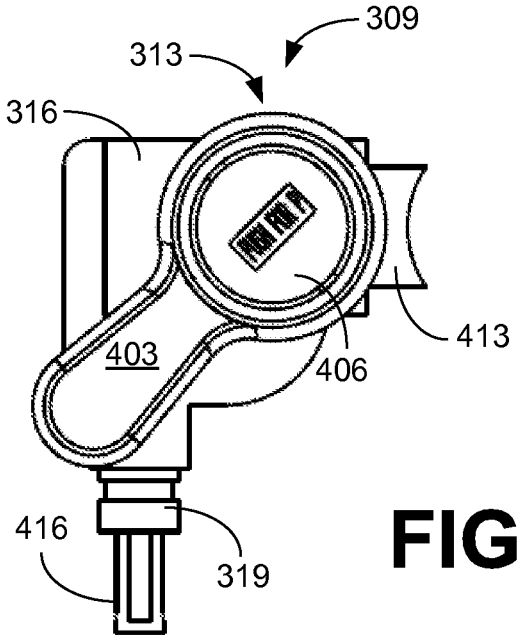
Figure 4C:
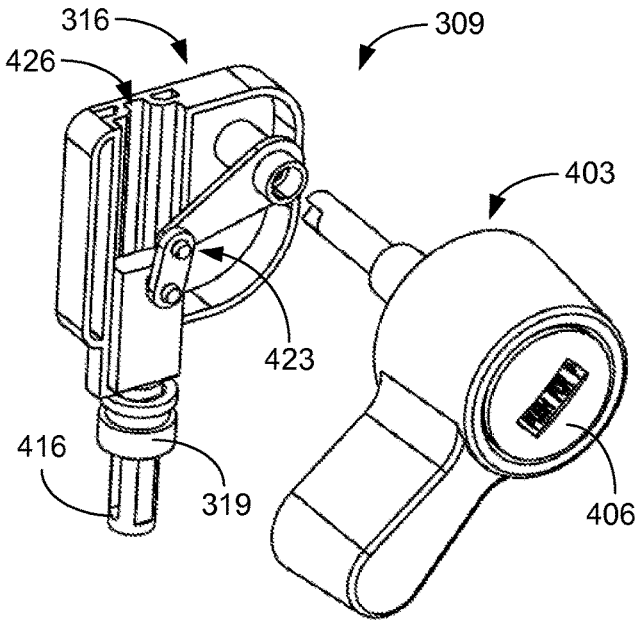
Figure 4D:
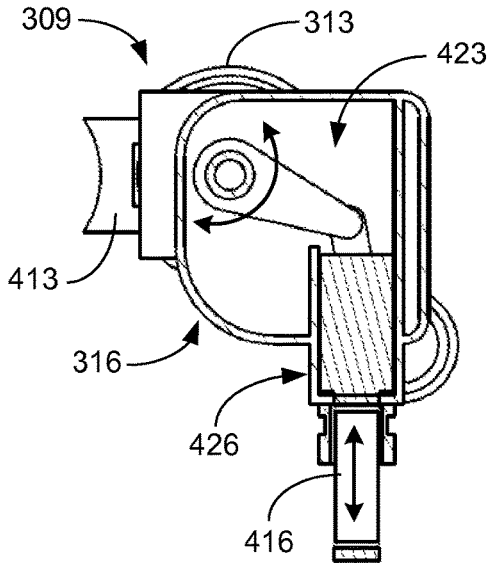

The transfer box 316 includes a plunger 416 that extends from the end of the mounting extension 319 into the actuation control box 113 when the handle assembly 313 is rotated. FIGS. 4C and 4D provide cross-sectional views of transfer box 316. The shaft of the handle lever 403 engages with a linkage assembly 423 to translate the rotational motion of the handle lever 403 into the linear motion of the plunger 416 by constraining movement within slot 426. While the embodiment of FIGS. 4C and 4D includes a single intermediate link in the linkage assembly, other embodiments may include more intermediate links or no intermediate link.

The operation of the activation assembly 306 with a handle converter assembly 309 is now discussed with reference next to FIGS. 4A-G. When the actuation control box 113 is in a neutral position (FIG. 2C), the handle lever 403 is in a horizontal position with plunger 416 retracted in mounting extension 319. Rotating the handle lever 403 without depressing the handle button 406 initiates a "full flush" of the dual flush assembly 103. When handle button 406 is not pressed, handle lever 403 can be rotated in a counter clockwise direction to fully extend plunger 416 as depicted in FIGS. 4A-D. Extension of plunger 416 into the actuation control box 113 causes cam 223 (FIG. 2D) to rotate about fixed point 226, retracting cable 229 in cable assembly 116 of FIG. 3.

Figure 4E:
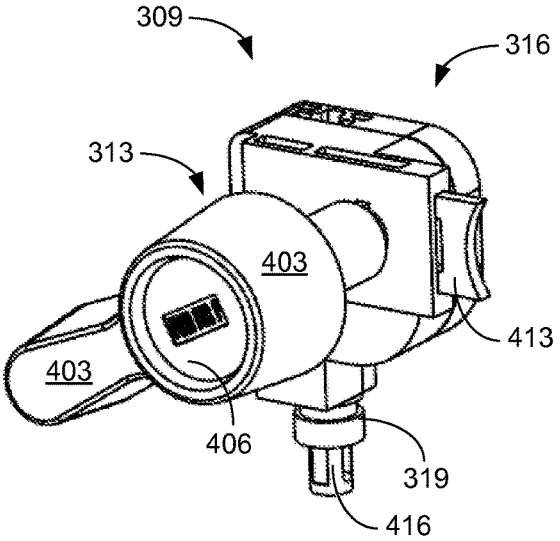
Figure 4F:
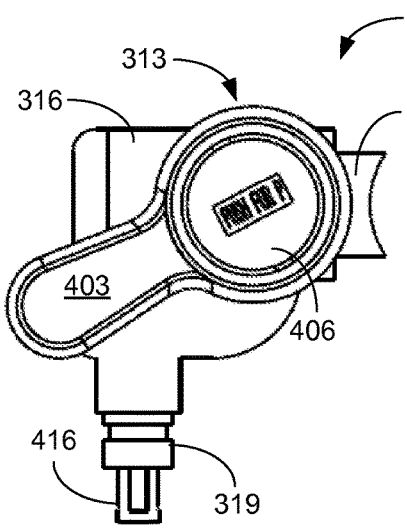
Figure 4G:
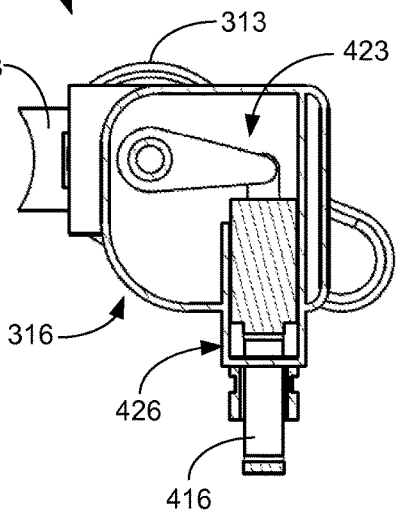

Depressing handle button 406 before rotating handle lever 403 restricts the rotation of handle assembly 313, and thus the extension of plunger 416, to an intermediate position that provides for a "quick flush" of the dual flush assembly 103. FIGS. 4E-G illustrates the restricted rotation of the handle lever 403 with handle button 406 depressed. As depicted in FIG. 4G, rotation of the handle lever 403 is translated by the linage assembly 423 to linear movement of plunger 416 until the intermediate position is reached.

Figure 5A:
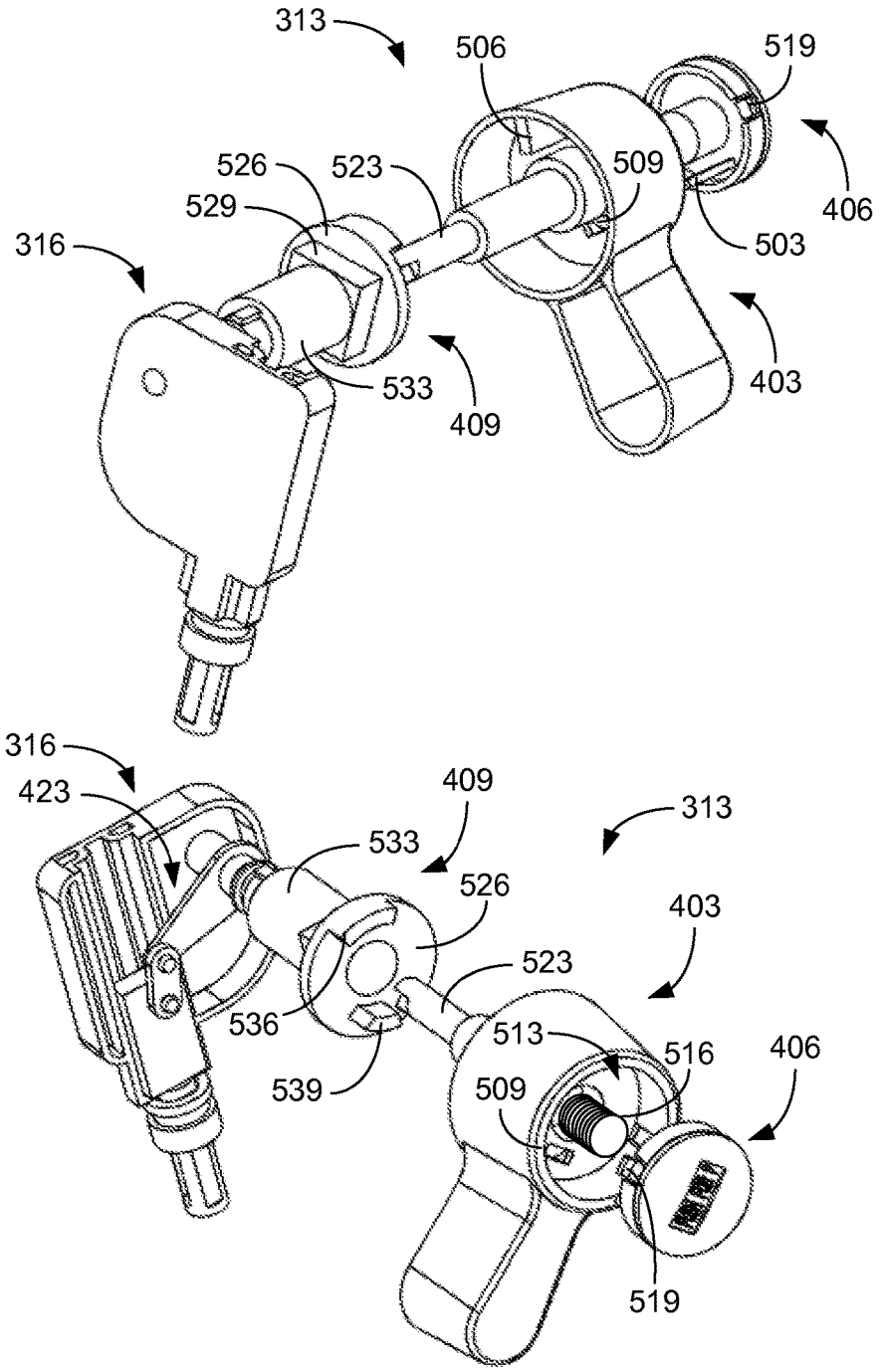

Referring next to FIGS. 5A-D, shown is the handle assembly 313. FIG. 5A provides exploded views of the handle assembly 313, including handle lever 403, handle button 406, and mounting sleeve 409, aligned with transfer box 316. Handle button 406 includes a quick flush tab 503 and handle lever 403 includes a full flush tab 506 and an opening 509. When handle button 406 is inserted into button recess 513 of the handle lever 403, the quick flush tab 503 extends through opening 509 into handle lever 403 (see FIG. 5B). The handle button 406 is held in an extended position, as depicted in FIGS. 4A-C, by a spring 516 and locking tabs 519 that engage with corresponding slots along the sides of button recess 513. This arrangement allows handle button 406 to be depressed, as depicted in FIGS. 4E-G, further extending the quick flush tab 503 into handle lever 403.

Handle lever 403 also includes a shaft 523 that, when assembled, extends through the center of mounting sleeve 409 and engages with a linkage assembly 423. Mounting sleeve 409 includes a tank shoulder 526, an alignment element 529, and a shaft sleeve 533. When mounting sleeve 409 is inserted through an opening in the wall of a toilet tank, tank shoulder 526 engages with the outer surface of the tank and alignment element 529 engages with the opening to maintain the orientation and prevent rotation of the mounting sleeve 409 within the wall of the tank. In some embodiments, shaft sleeve 533 may be threaded to receive a nut (not shown) or other fastener to hold the mounting sleeve 409 in position within the wall of the tank. The tank shoulder 526 also includes a full flush stop 536 and a quick flush stop 539 to limit the rotation of the handle lever 403 during operation.

Figure 5B:
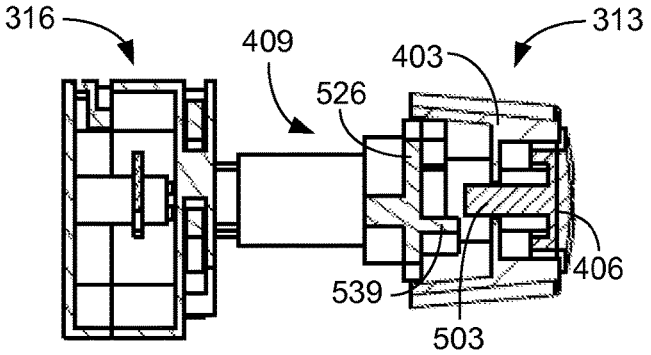
Figure 5C:
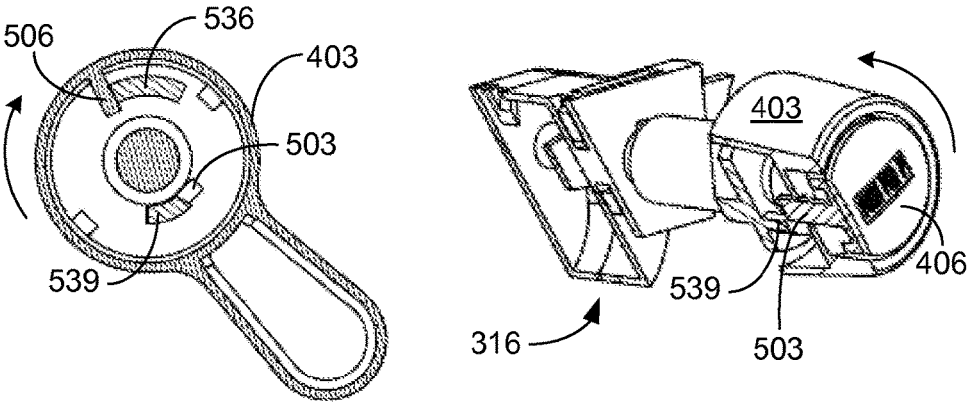
Figure 5D:
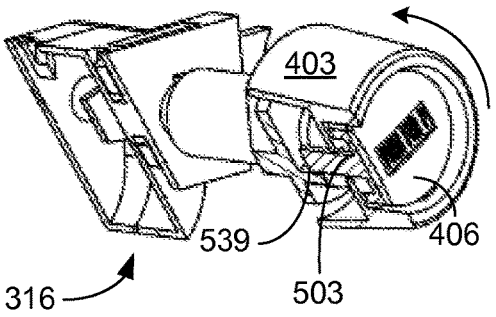

FIGS. 5B-D illustrate cross-sectional views of the assembled handle assembly 313. During operation of the dual flush assembly 103 (FIG. 3), positioning of the handle button 406 determines the extent to which the handle lever 403 can be rotated, thus controlling which of the dual flush modes is initiated. When the handle button 406 is in the extended position as depicted in FIGS. 5B-C, handle lever 403 may be rotated to fully extend plunger 416 (FIGS. 4A-D) to initiate the "full flush" mode of the dual flush assembly 103. Full flush tab 506 engages full flush stop 536 when handle lever 403 is fully rotated to prevent further extension of plunger 416, while quick flush tab 503 does not engage quick flush stop 539 as illustrated in FIG. 5C.

Initiation of the "quick flush" mode of the dual flush assembly 103 is performed by depressing handle button 406 and rotating handle lever 403. With handle button 406 depressed, the quick flush tab 503 is sufficiently extended to engage with quick flush stop 539 when the handle lever 403 is rotated as illustrated in FIG. 5D. Engagement of the quick flush tab 503 with quick flush stop 539 prevents further rotation of the handle lever 403 to prevent extension of plunger 416 (FIGS. 4E-G) past the intermediate "quick flush" position.

With reference to FIGS. 6A-E, shown is another embodiment of an activation assembly 606 detachably connected to actuation control box 113. The activation assembly 606 including a handle converter assembly 609 detachably connected to actuation control box 113. The handle converter assembly 609 includes a handle assembly 613 in communication with a transfer box 616. The transfer box 616 is detachably connected to the actuation control box 113 through a mounting extension 619 in a fashion similar to the actuation control box 113 of FIGS. 2A-F.

Figure 6A:
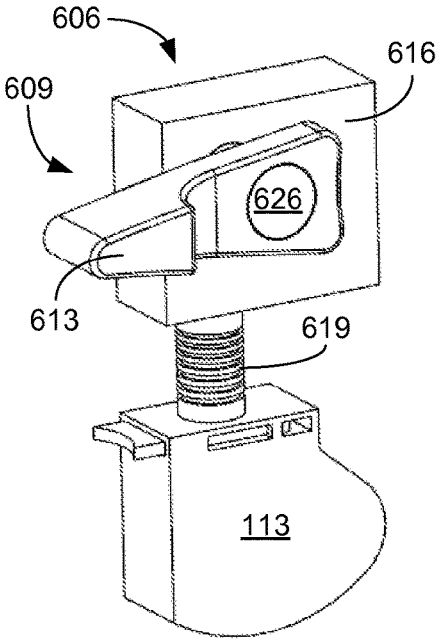
FIGS. 6A-6E and 7A-7E are drawings that provide various views of another handle converter assembly of FIG. 3 according to various embodiments of the disclosure.
Figure 6B:
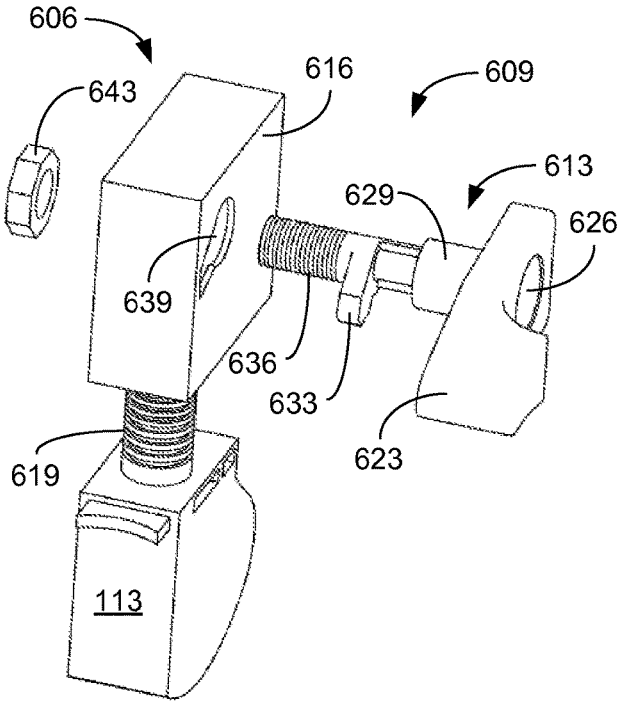

FIG. 6B is an exploded view of the handle converter assembly 609. The handle assembly 613 includes a handle lever 623, a handle button 626, and a mounting sleeve 629 through which the shaft of the handle assembly 613 extends. The handle assembly 613 also includes cam 633. The handle assembly 313 is detachably connected to transfer box 316 by inserting threaded extension 636 and cam 633 through opening 639 and securing in position with nut 643.

Figure 6C:
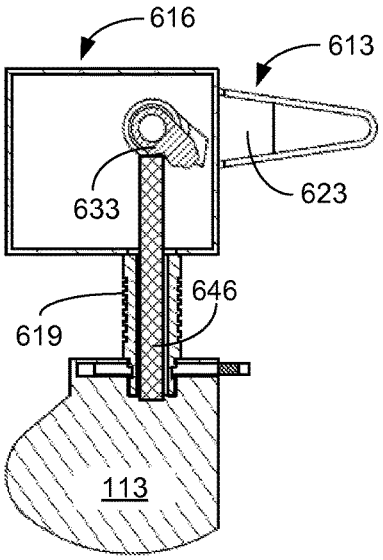
Figure 6D:
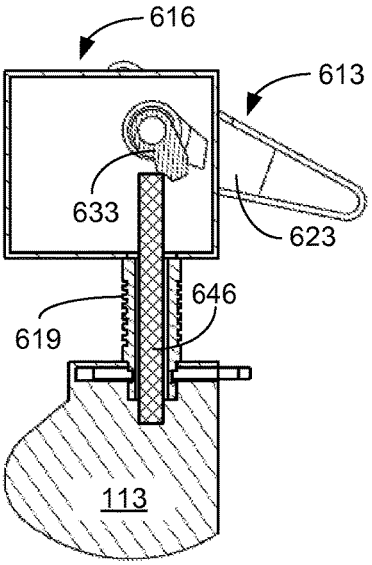
Figure 6E:
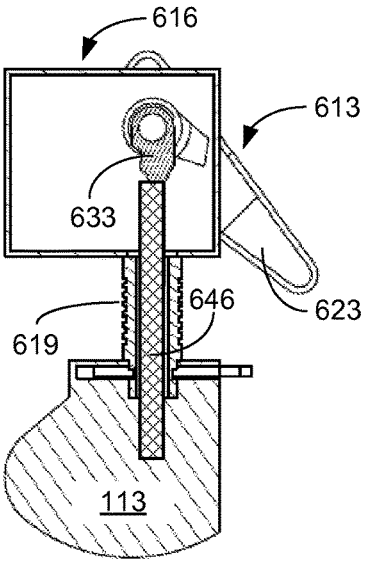

Referring next to FIGS. 6C-E, the transfer box 616 includes a plunger 646 that extends from the end of the mounting extension 619 into the actuation control box 113 when the handle assembly 613 is rotated. Cam 633 engages with plunger 646 to translate the rotational motion of the handle assembly 613 into the linear motion of the plunger 646.

The operation of the activation assembly 606 with a handle converter assembly 613 is now discussed with reference to the cross-sectional views of FIGS. 6C-E. When the actuation control box 113 is in a neutral position (FIG. 2C), the handle lever 623 is in a horizontal position with plunger 646 retracted in mounting extension 619. Rotating the handle lever 623 without depressing the handle button 626 initiates a "full flush" of the dual flush assembly 103 (FIG. 3). When handle button 626 is not pressed, handle lever 623 can be rotated causing cam 633 to fully extend plunger 646 as depicted in FIG. 6E. Extension of plunger 646 into the actuation control box 113 causes cam 223 (FIG. 2D) to rotate about fixed point 226, retracting cable 229 in cable assembly 116 of FIG. 3.

Depressing handle button 626 before rotating handle lever 623 restricts the rotation of handle assembly 613, and thus the extension of plunger 646, to an intermediate position that provides for a "quick flush" of the dual flush assembly 103. FIG. 6D illustrates the restricted rotation of the handle assembly 613 with handle button 626 depressed. As depicted in FIG. 6D, rotation of the handle lever 623 is translated by cam 633 to linear movement of plunger 646 by applying a force to the top of plunger 646. An intermediate cam notch or recess of cam 633 engages plunger 646 when in the intermediate position.

Figure 7A:
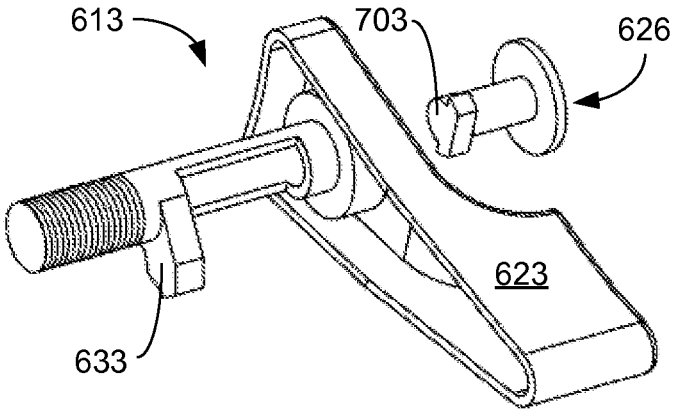
Figure 7B:
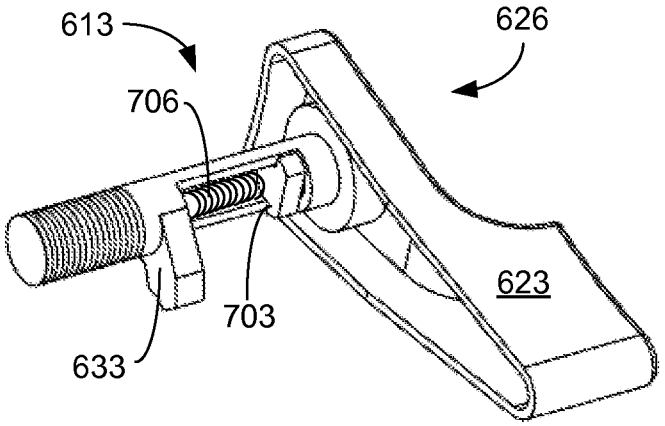

Referring next to FIGS. 7A-E, shown are the handle assembly 613 and mounting sleeve 629. FIG. 7A provides an exploded view of the handle assembly 613, including handle lever 623, handle button 626, and cam 633. Handle button 626 includes a rotation tab 703 that, when inserted through handle lever 623, extends from the side of the shaft of the handle assembly 613 as depicted in FIG. 7B. The handle button 626 is held in an extended position, as depicted in FIG. 7B, by a spring 706. When assembled as in FIG. 6B, the shaft of the handle assembly 613 extends through mounting sleeve 629 with rotation tab 703 located within the mounting sleeve 629 (see FIGS. 7D-E).

Figure 7C:
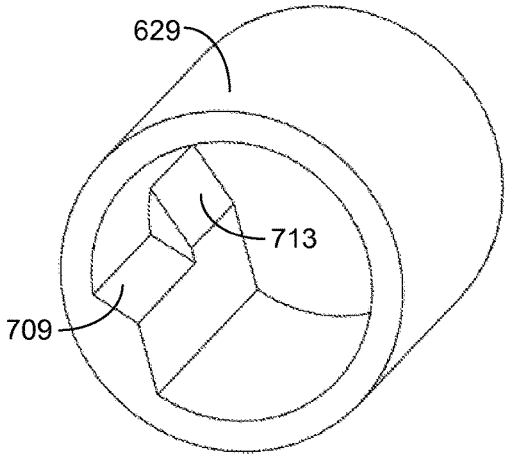
Figure 7D:
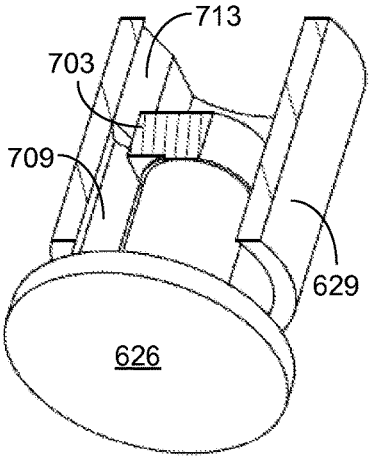

FIG. 7C illustrates a cross-sectional view of the mounting sleeve 629. A full flush stop 709 and a quick flush stop 713 are included within the mounting sleeve 629. During operation of the dual flush assembly 103 (FIG. 3), positioning of the handle button 626 determines the extent to which the handle lever 623 can be rotated, thus controlling which of the dual flush modes is initiated. When the handle button 626 is in the extended position as depicted in FIGS. 6A-B and 7D, handle lever 623 may be rotated to fully extend plunger 646 (FIG. 6E) to initiate the "full flush" mode of the dual flush assembly 103. Rotation tab 703 engages full flush stop 709 when handle lever 623 is fully rotated to prevent further extension of plunger 646.

Figure 7E:
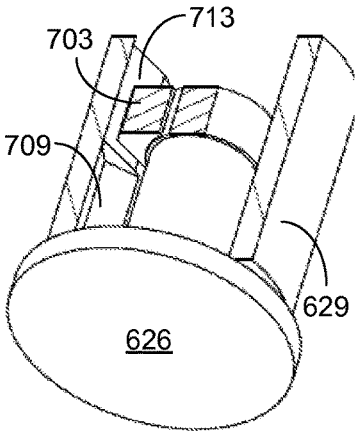

Initiation of the "quick flush" mode of the dual flush assembly 103 is performed by depressing handle button 626 and rotating handle lever 623 to extend plunger 646 as illustrated in FIG. 6D. With handle button 626 depressed, the rotation tab 703 is sufficiently extended to engage with quick flush stop 713 when the handle lever 623 is rotated as illustrated in FIG. 7E. Engagement of the rotation tab 703 with quick flush stop 713 prevents further rotation of the handle lever 623 to prevent extension of plunger 646 (FIG. 6D) past the intermediate "quick flush" position.

Figure 8A:
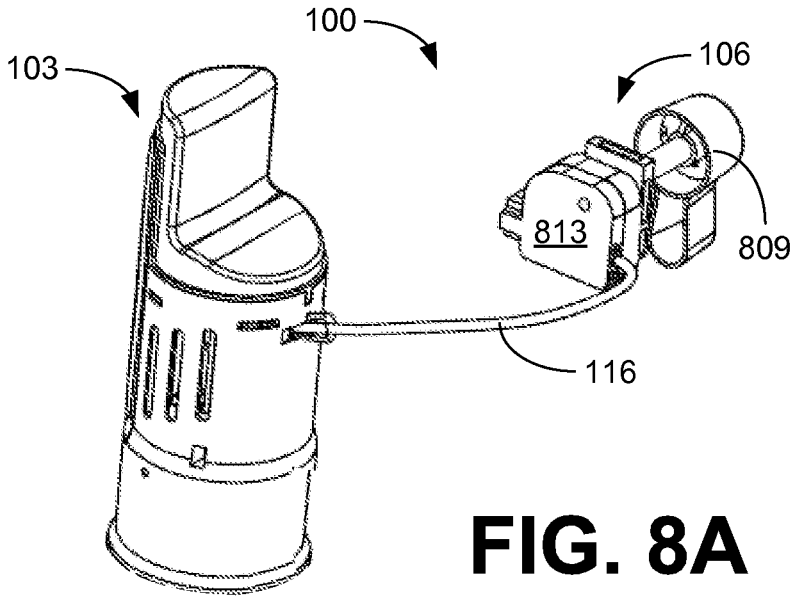
FIGS. 8A-8B are drawings of a dual flush toilet system with rotational activation.
Figure 8B:
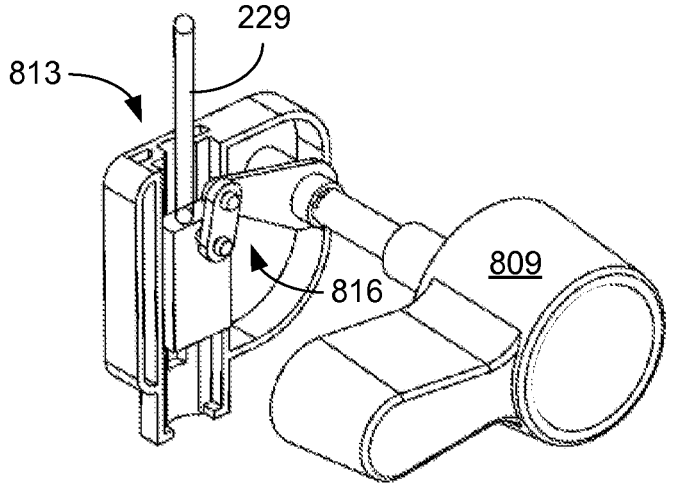

With reference to FIGS. 8A-B, shown is a dual flush toilet system 100 including a dual flush assembly 103 and an activation assembly 106 to initiate operation of the dual flush assembly 103 in one of the dual flush modes: quick flush for liquids and full flush for solids. In the embodiment of FIG. 8A, the activation assembly 806 includes a lever handle 809 that is detachably connected to an actuation control box 813. The actuation control box 813 is in communication with the dual flush assembly 103 through a cable assembly 116, which is directly connected to the actuation control box 813 and the body of the dual flush assembly 103. FIG. 8B provides a cross-sectional view of the actuation control box 813. Rotational motion of lever handle 809 is converted into linear motion of cable 229 in cable assembly 116 in the actuation control box 813 by linkage assembly 816. Full rotation of the lever handle 809 initiates a "full flush" of the dual flush assembly 103, while rotation of the lever handle 809 to only an intermediate position initiates a "quick flush" of the dual flush assembly 103.

Figure 9A:
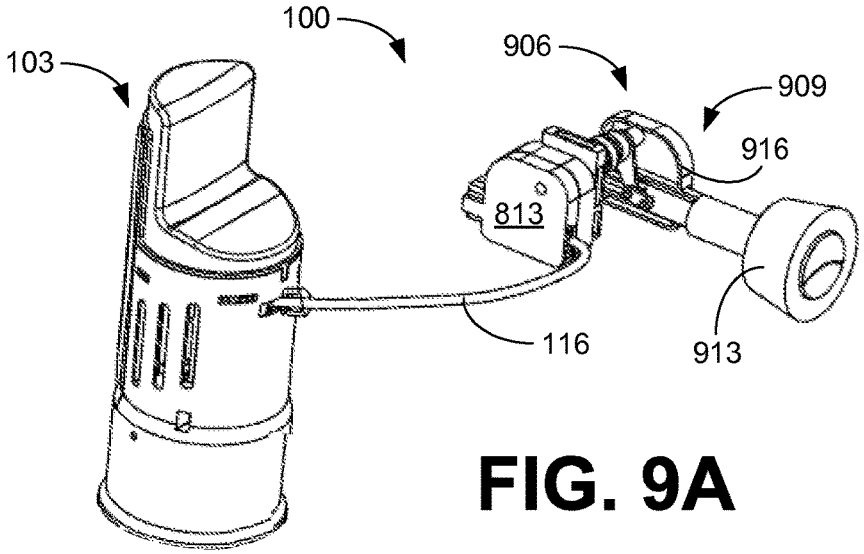
FIGS. 9A-9B are drawings of the dual flush toilet system of FIG. 8A including a push button converter assembly according to various embodiments of the disclosure.
Figure 9B:
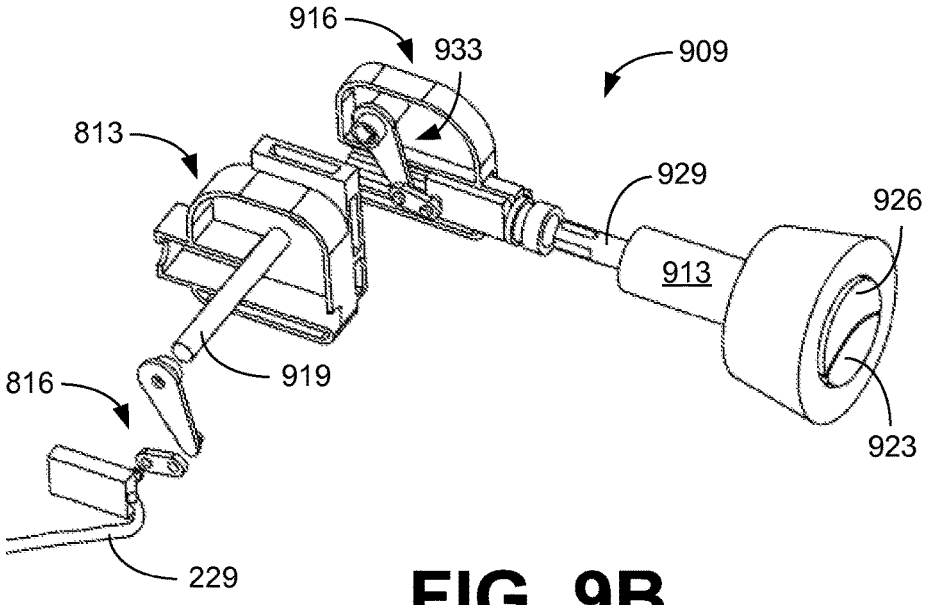

With reference next to FIGS. 9A-B, shown is the dual flush toilet system 100 including a dual flush assembly 103 and an activation assembly 906 including a push button converter assembly 909 detachably connected to actuation control box 813. The push button converter assembly 909 includes a push button assembly 913 in communication with a transfer box 916. The transfer box 916 is detachably connected to the actuation control box 813 through an interconnection shaft 919 that engages with actuation control box 813.

FIG. 9B provides an exploded view of the push button converter assembly 909 including push button assembly 913 and transfer box 916. The push button assembly 913 includes a first button 923 for activation of the quick flush mode with a reduced amount of water usage and a second button 926 for activation of the full flush mode using the standard amount of water. Depressing the first "quick flush" button 923 extends the plunger 929 to a predetermined intermediate position (see e.g., the extension of plunger 219 in FIG. 2E), while depressing the second "full flush" button 926 fully extends the plunger 929 (see e.g., the extension of plunger 219 in FIG. 2F).

Transfer box 916 includes interconnection shaft 919 (shown extending through the side of actuation control box 813) engaged with linkage assembly 933. The push button assembly 913 is detachably connected to transfer box 916 so that plunger 929 is in communication with linkage assembly 933. While the embodiment of FIGS. 9A-B includes a single intermediate link in linkage assembly 933, other embodiments may include more intermediate links or no intermediate link. Linkage assembly 933 translates the linear motion of plunger 929 into rotational motion, which is transferred to actuation control box 813 through interconnection shaft 919. The push button assembly 913 is detachably connected to the actuation control box 813 through interconnection shaft 919, which is in communication with linkage assembly 816. Linkage assembly 816 translates the rotational motion of interconnection shaft 919 into the linear motion of cable 229. In this way, linear motion of the plunger 929 is converted into linear motion of cable 229 in cable assembly 116.

The operation of the activation assembly 906 with a push button converter assembly 909 is now discussed. With neither button 923 or 926 depressed, plunger 929 remains in a retracted position. Depressing the "quick flush" button 923 extends the plunger 929 to the predetermined intermediate position. The linear movement of plunger 929 is transferred to cable 229 through linkage assembly 933 and interconnection shaft 919 to initiate a "quick flush" of the dual flush assembly 103. Depressing the "full flush" button 926 fully extends the plunger 929. The linear movement of plunger 929 is transferred to cable 229 to initiate a "full flush" of the dual flush assembly 103. When buttons 923 and 926 are released, the plunger 929 returns to its retracted position, returning cable 229 to its original neutral position.

With reference back to FIG. 1, shown is a dual flush toilet system 100 including a dual flush assembly 103 and a push activation assembly 106 to initiate operation of the dual flush assembly 103 in one of the dual flush modes: quick flush for liquids and full flush for solids. In the embodiment of FIG. 1, the push activation assembly 106 includes a push button assembly 109 that is detachably connected to a push actuation control box 113. The push actuation control box 113 is in communication with the dual flush assembly 103 through a cable assembly 116, which is directly connected to the push actuation control box 113 and the body of the dual flush assembly 103.

Referring next to FIGS. 2A-F, the operation of the push activation assembly 106 is illustrated. The push button assembly 109 is detachably connected to the push actuation control box 113 through a shaft extension 203, which is threaded to mount the push button assembly 109 to the tank of the toilet with a nut. In the embodiment of FIGS. 2A-F, the end 206 of the shaft extension 203 is engaged with the push actuation control box 113 by a spring-loaded clip assembly 209. By pressing the end of clip assembly 209, the push button assembly 109 may be detached from the push actuation control box 113. The push button assembly 109 includes a first button 213 for activation of the quick flush mode with a reduced amount of water usage and a second button 216 for activation of the full flush mode using the standard amount of water.

FIG. 2C illustrates a cross-sectional view of the push activation assembly 106 of FIG. 2A. FIGS. 2A and 2C show the push actuation control box 113 in a neutral position without buttons 213 or 216 depressed. Depressing one of the buttons 213 or 216 extends a plunger 219 from the end of the shaft extension 203 into the push actuation control box 113. In the exemplary embodiment of FIGS. 2C-D, extension of plunger 219 causes a cam 223 to rotate about a fixed point 226, extracting a cable 229 from cable assembly 116 of FIG. 1. In this way, linear motion of the plunger 219 is converted into linear motion of cable 229 in cable assembly 116. Depressing the first "quick flush" button 213 extends the plunger 219 to a predetermined intermediate position as illustrated in FIG. 2E, while depressing the second "full flush" button 216 fully extends the plunger 219 as depicted in FIGS. 2B and 2F. When the plunger 219 is retracted after the desired flush is initiated, cam 223 and cable 229 return to the neutral position depicted in FIG. 2C.

Figure 10A:
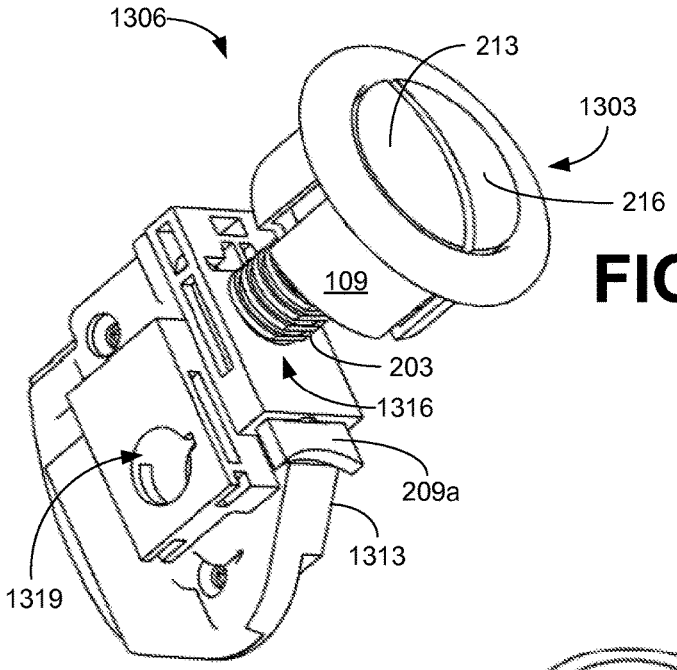
FIGS. 10A-10F are drawings of a dual-input activation assembly for use in the dual flush toilet system of FIG. 1 according to various embodiments of the disclosure.
Figure 10B:
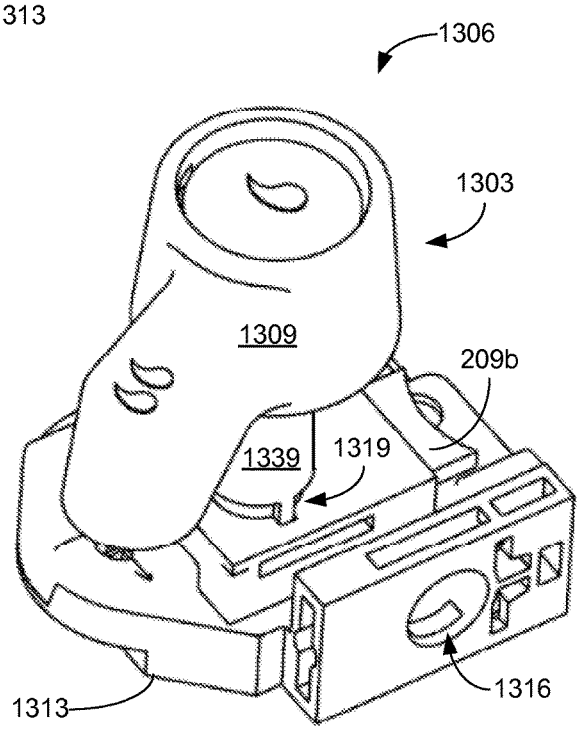
Figure 10C:
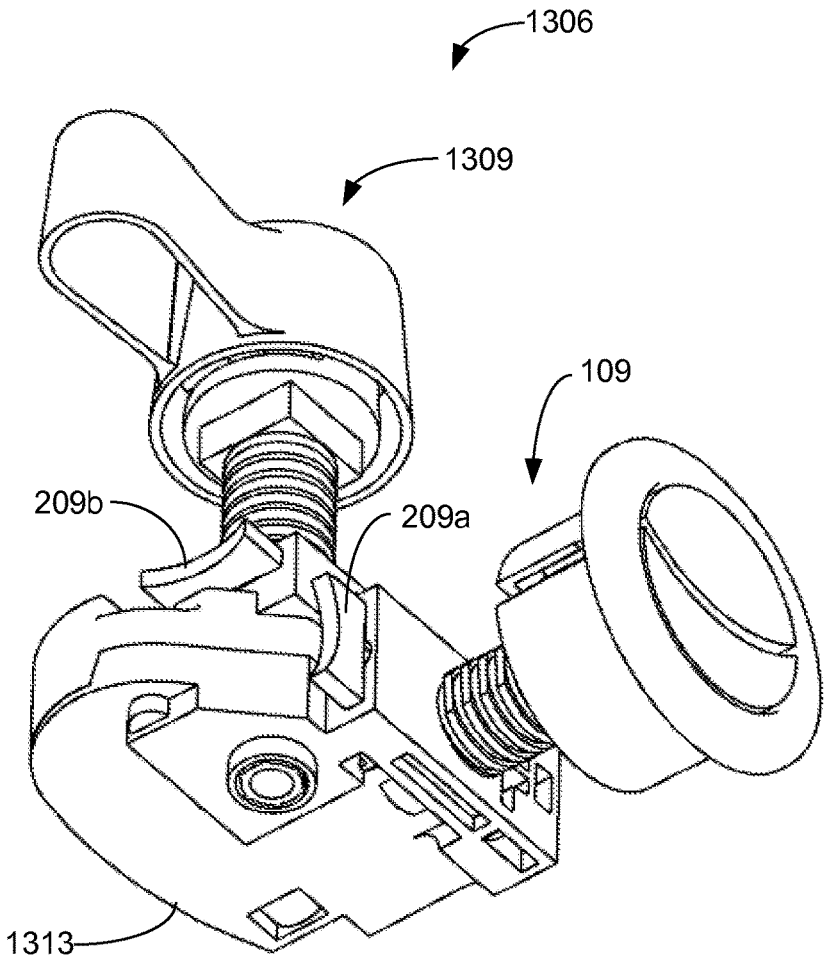

With reference to FIGS. 10A and 10B, shown is a dual-input activation assembly 1306 that may be used in the dual flush toilet system 100 of FIG. 1 according to various embodiments of the disclosure. The dual-input activation assembly 1306 includes an activation control assembly 1303 detachably connected to a dual-input actuation control box 1313. In the exemplary embodiment of FIG. 10A, the activation control assembly 1303 is a push button assembly 109 detachably connected to the dual-input actuation control box 1313 through a linear input connection 1316. The push button assembly 109 includes the first button 213 for activation of the quick flush mode and the second button 216 for activation of the full flush mode. In a second configuration illustrated in FIG. 10B, the activation control assembly 1303 is a rotary handle assembly 1309 detachably connected to the dual-input actuation control box 1313 through a rotational input connection 1319. FIG. 10C illustrates dual-input activation assembly 1306 with both a push button assembly 109 and a rotary handle assembly 1309 detachably connected to the dual-input actuation control box 1313.

Figure 10D:
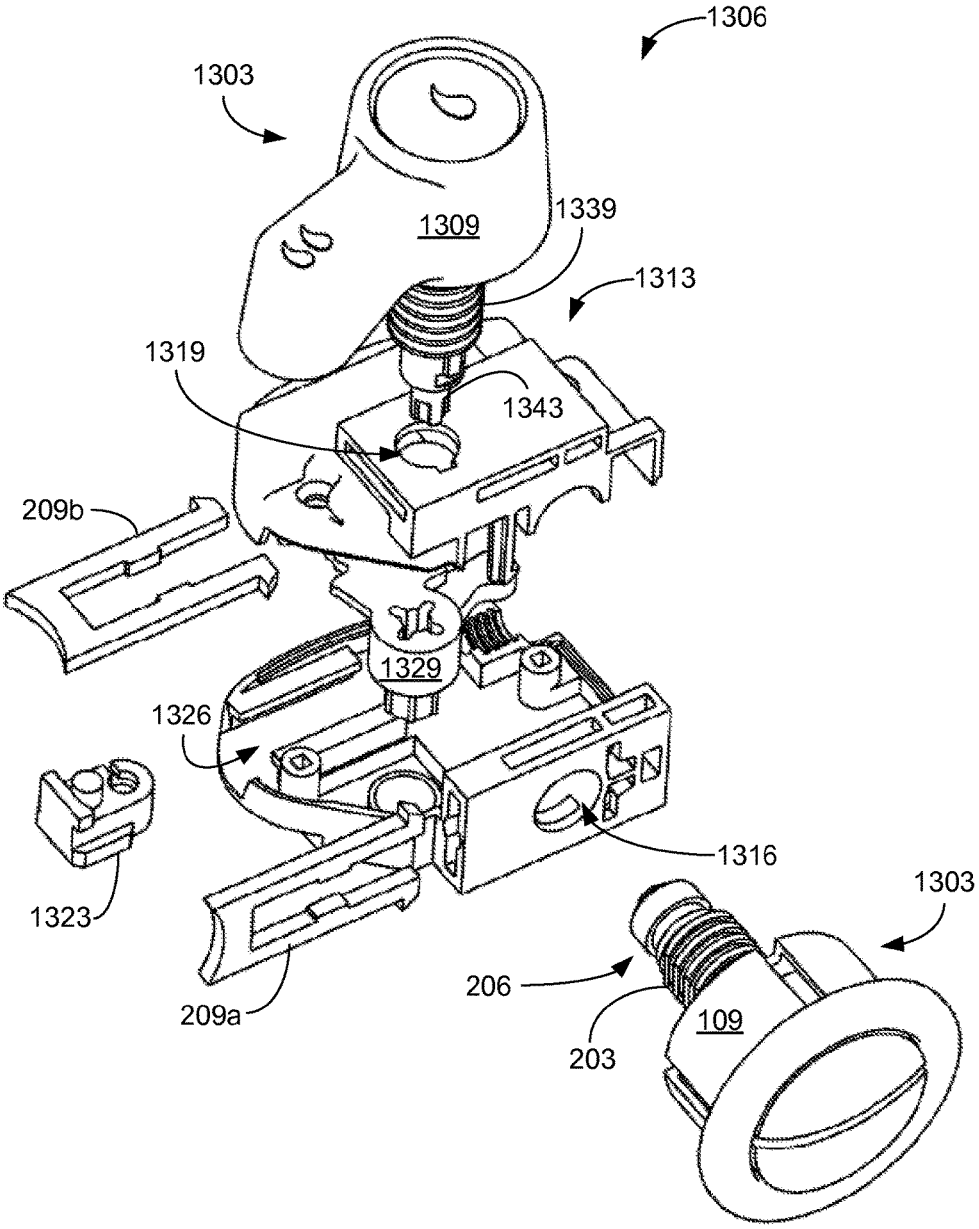

Referring now to FIG. 10D, shown is an exploded view of the dual-input activation assembly 1306. The dual-input actuation control box 1313 includes a cable anchor 1323 that detachably connects one end of the cable 229 of cable assembly 116 (see e.g., FIGS. 11A-11G). Cable anchor 1323 is constrained within the dual-input actuation control box 1313 by a linear guide path 1326. The dual-input actuation control box 1313 also includes a dual-input cam 1329 configured to translate activation motion of either the push button assembly 109 or the rotary handle assembly 1309 into linear motion of the cable anchor 1323, and thus an attached cable 229 in cable assembly 116. The dual-input actuation control box 1313 is configured to allow the dual-input cam 1329 to rotate about a rotational axis that is substantially perpendicular to the linear guide path 1326.

The push button assembly 109 may be detachably connected to the dual-input actuation control box 1313 through the linear input connection 1316. In the embodiments of FIGS. 10A-10D, the end 206 of the shaft extension 203 of the push button assembly 109 is engaged with the push actuation control box 113 by a spring-loaded clip assembly 209*a*. By pressing the end of clip assembly 209*a*, the push button assembly 109 may be detached from the dual-input actuation control box 1313.

Figure 10E:
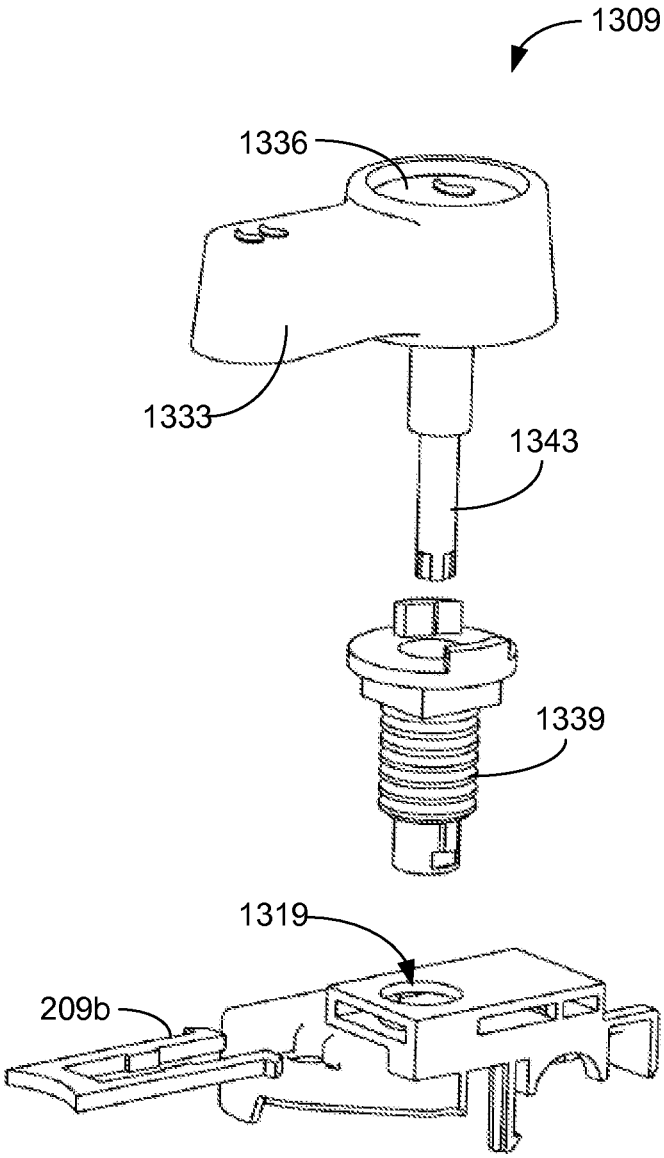
Figure 10F:
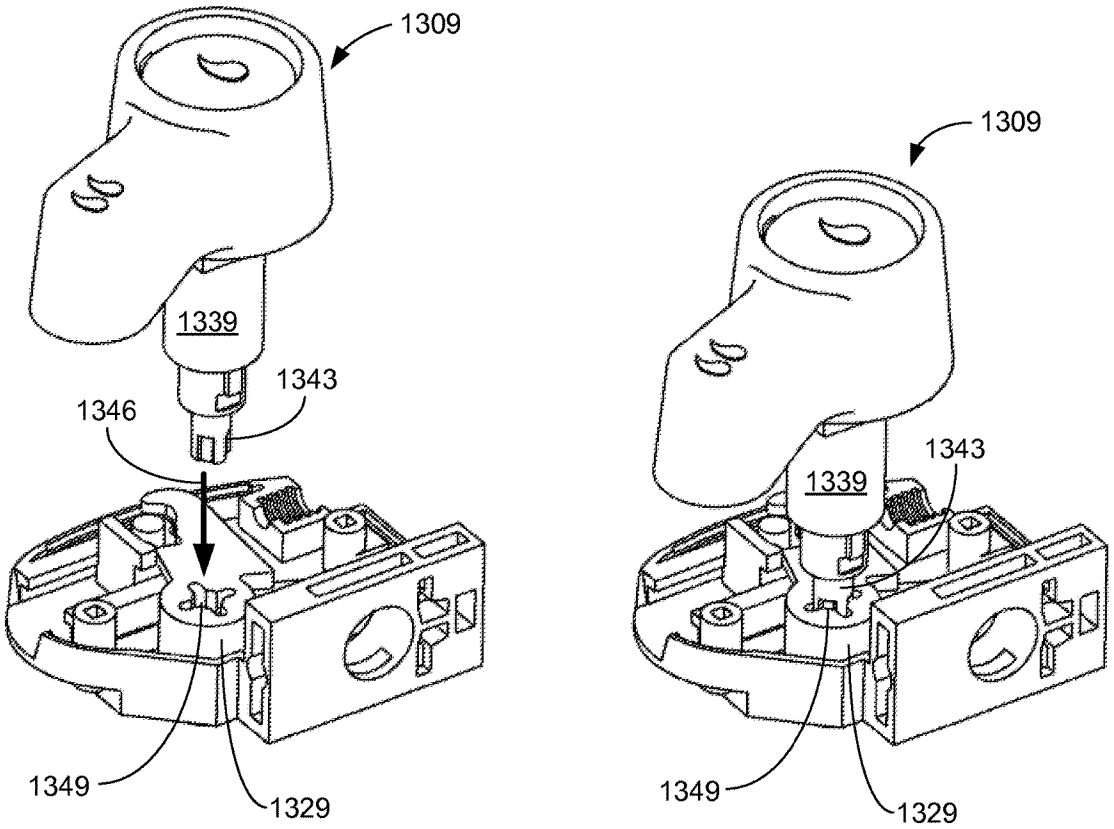

The rotary handle assembly 1309 may also be detachably connected to the dual-input actuation control box 1313 through a rotational input connection 1319. Referring to FIG. 10E, shown is an exploded view of the rotary handle assembly 1309. The rotary handle assembly 1309 includes a handle lever 1333, and may include a handle button 1336 and a mounting sleeve 1339 through which the shaft 1343 of the handle lever 1333 extends. In the embodiments of FIGS. 10A-10F, the end of the mounting sleeve 1343 is engaged with the dual-input actuation control box 1313 and may be detachably connected by a spring-loaded clip assembly 209*b* or other appropriate connection. By pressing the end of clip assembly 209*b*, the rotary handle assembly 1309 may be detached from the dual-input actuation control box 1313.

When detachably connected to the dual-input actuation control box 1313, the rotary handle assembly 1309 engages with dual-input cam 1329. Referring now to FIG. 10E, as the rotary handle assembly 1309 is inserted (depicted as arrow 1346) through the rotational input connection 1319 (FIGS. 10A-10E), the end of the handle shaft 1343 engages with a corresponding opening 1349 in the dual-input cam 1329. In the embodiments of FIGS. 10A-10F, the end of the shaft 1343 of the handle lever 1333 includes a spline that aligns with opening 1349 to provide for torque transfer to the dual-input cam 1329. Other embodiments may utilize shaft end shapes such as, but not limited to, square, triangular, hexagonal, and keyed and a correspondingly shaped opening 1349 in the dual-input cam 1329.

Figure 11A:
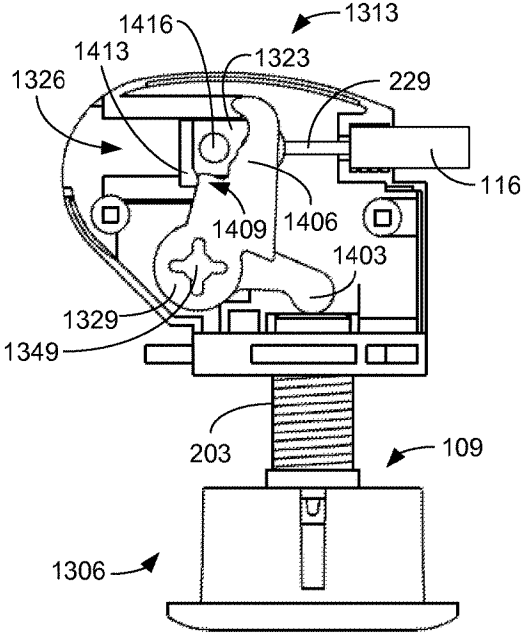
FIGS. 11A-11G are drawings that provide various views of the dual-input activation assembly of FIG. 10 according to various embodiments of the disclosure.
Figure 11B:
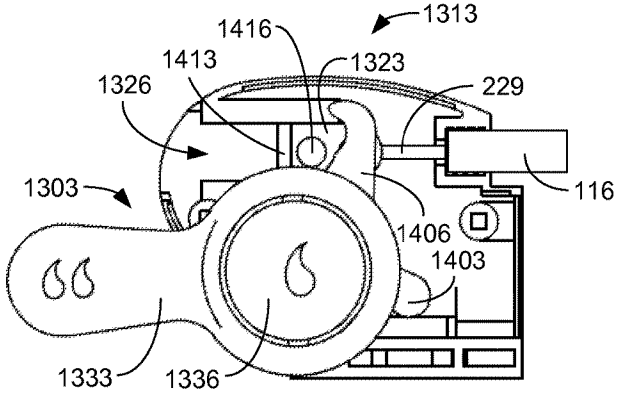
Figure 11C:
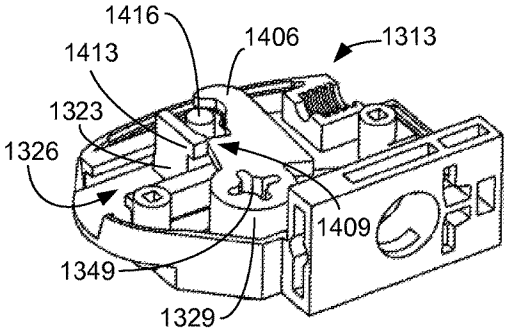

Next, operation of the dual-input activation assembly 1306 is now discussed with reference next to FIGS. 11A-11G. FIGS. 11A-11C illustrate the dual-input activation assembly 1306 in a neutral position. FIG. 11A depicts the dual-input actuation control box 1313 in the neutral position without either the first button 213 (FIG. 10A) for activation of the quick flush mode or the second button 216 (FIG. 10A) for activation of the full flush mode depressed. In addition, when the dual-input actuation control box 1313 is in a neutral position as depicted in FIG. 11B, the handle lever 1333 is in a neutral position. In the embodiment of FIG. 11B, the handle lever 1333 is in a horizontal position. FIG. 11C provides a cutaway view of the dual-input actuation control box 1313 in the neutral position. In the neutral position, the cable 229 is retracted in cable assembly 116 and the cable anchor 1323 is at a neutral position in the linear guide path 1326.

Depressing one of the buttons 213 or 216 extends a plunger 219 (FIGS. 11D and 11F) from the end of the shaft extension 203 into the dual-input actuation control box 1313. In the exemplary embodiments of FIGS. 11D and 11F, as the plunger 219 extends, the plunger 219 engages plunger arm 1403 of the dual-input cam 1329 causing the dual-input cam 1329 to rotate about the rotational axis. The force provided through the plunger 219 is transferred through the dual-input cam 1329 to the cable anchor 1323 in the linear guide path 1326 by an anchor arm 1406. In the embodiments of FIGS. 11A-11G, the anchor arm 1406 is configured to exert an initial breakaway force on the cable anchor 1323, followed by a reduced translation force. In one embodiment, the higher breakaway force is exerted at a breakaway point 1409 of the anchor arm 1406 on a breakaway shoulder 1413 of the cable anchor 1323. As the cable anchor 1323 moves along the linear guide path 1326, the dual-input cam 1329 rotates about the rotational axis until the anchor arm 1406 engages a translation pin 1416 at a second position on the anchor arm 1406.

Figure 11D:
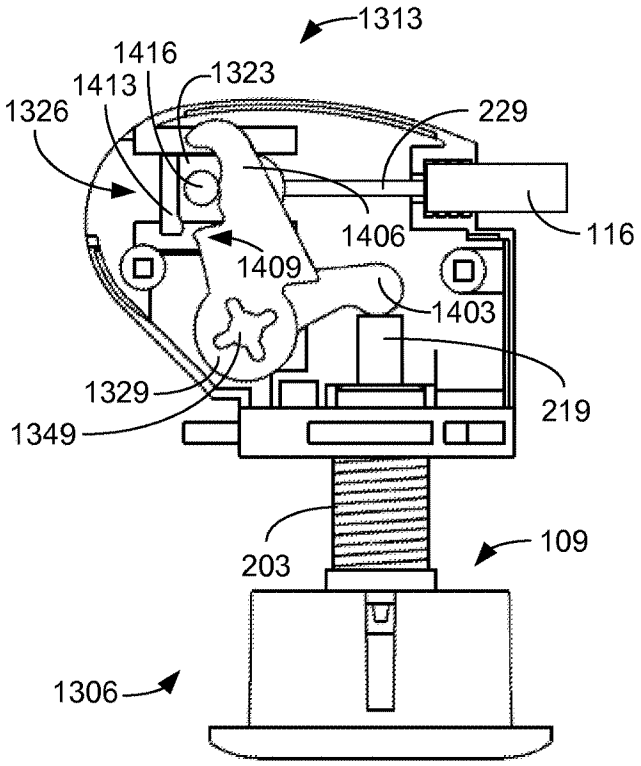
Figure 11E:
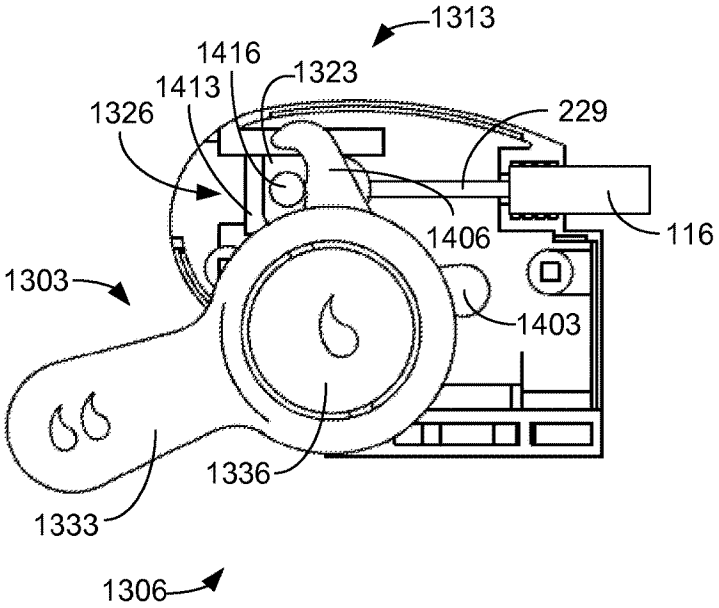
Figure 11F:
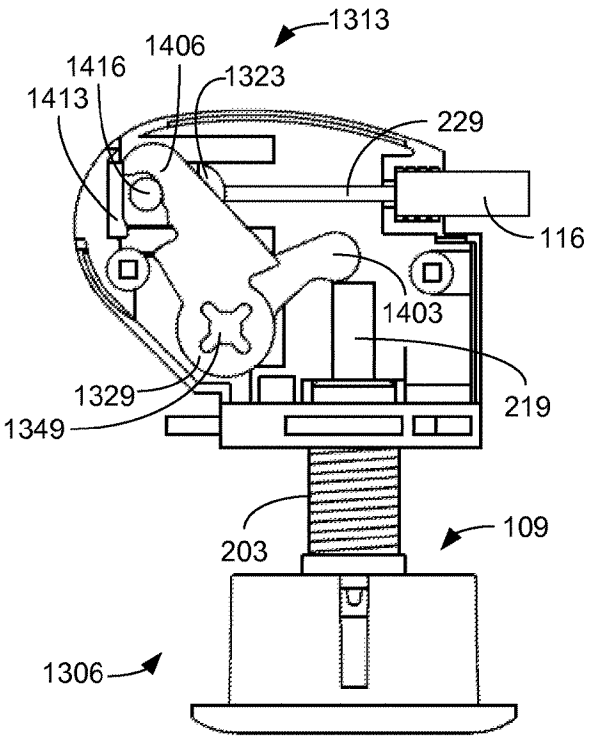

Further rotation of the dual-input cam 1329 exerts a reduced translation force on the cable anchor 1323 though the translation pin 1416 because of an increased lever arm length. Anchor arm 1406 disengages with the breakaway shoulder 1413, removing the breakaway force from the cable anchor 1323. Depressing the quick flush button 213 (FIG. 10A) extends the plunger 219 from the end of the shaft extension 203 to an intermediate quick flush position as illustrated in FIG. 11D. Depressing the full flush button 216 (FIG. 10A) fully extends the plunger 219 from the end of the shaft extension 203 to a full flush position as illustrated in FIG. 11F.

Figure 11G:
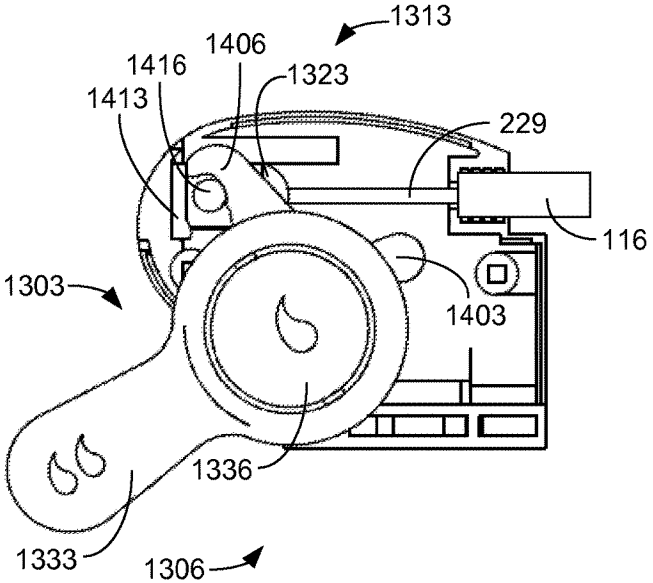

Counter clockwise rotation of the handle lever 1333 produces a similar result. The torque transferred from the handle lever 1333 to the dual-input cam 1329 through shaft 1343 and opening is exerted on the cable anchor 1323, initially as a breakaway force and subsequently as a reduced translation force as described above. Depressing handle button 1336 before rotating handle lever 1333 restricts the rotation of the handle assembly 1303, to the intermediate quick flush position as illustrated in FIG. 11E. Rotating the handle lever 1333 without depressing the handle button 1336 initiates a full flush of the dual flush assembly 103 by allowing the handle lever 1333 to be rotated in a counter clockwise direction beyond the quick flush restriction point. FIG. 11G illustrates the handle lever 1333 rotated to the full flush position.

Figure 12B:
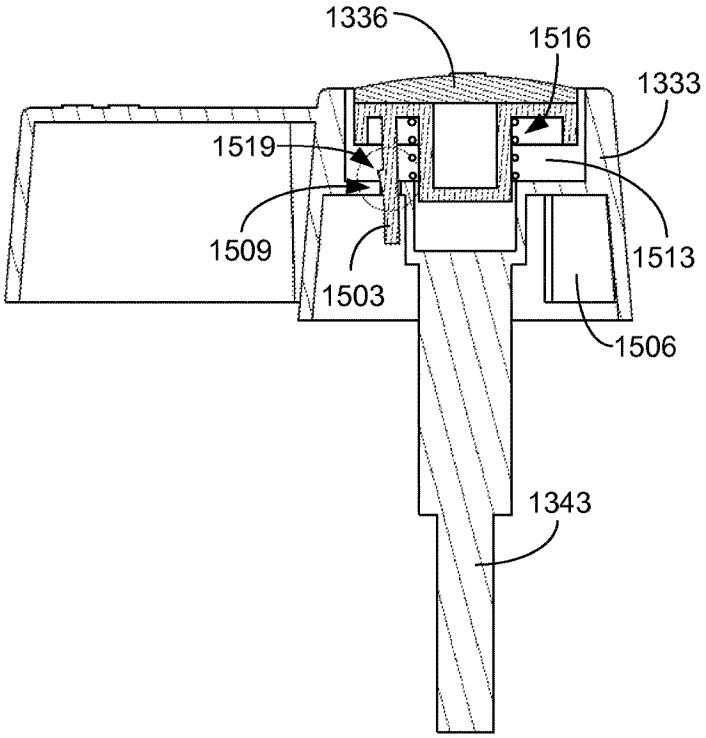
Figure 12A:
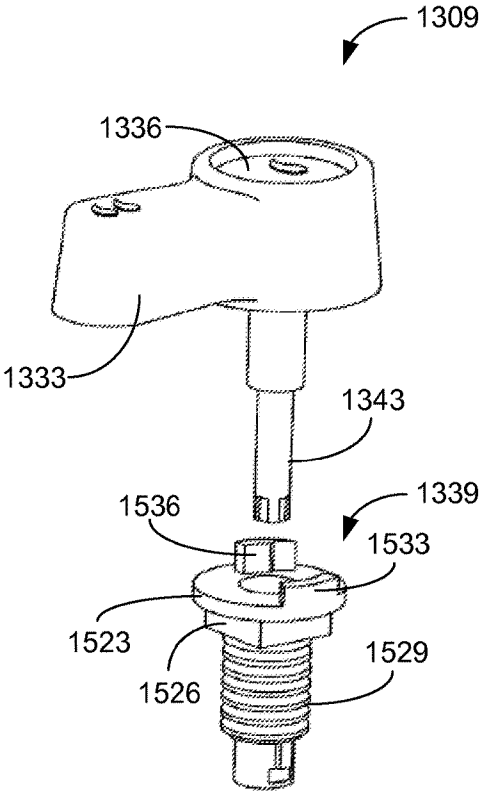

Referring next to FIGS. 12A-12G, shown is the rotary handle assembly 1309. FIG. 12A provides an exploded view of the handle assembly 1313, including handle lever 1333, handle button 1336, and mounting sleeve 1339. Handle lever 1333 also includes a shaft 1343 that, when assembled, extends through and locks into position (not shown) allowing the rotary handle assembly 1309 to rotate inside of shaft sleeve 1529 without the rotary handle assembly 1309 able to pull out of the center of mounting sleeve 1339. Mounting sleeve 1339 includes a tank shoulder 1523, an alignment element 1526, and a shaft sleeve 1529. When mounting sleeve 1339 is inserted through an opening in the wall of a toilet tank, tank shoulder 1523 engages with the outer surface of the tank and alignment element 1526 engages with the opening to maintain the orientation and prevent rotation of the mounting sleeve 1339 within the wall of the tank. In some embodiments, shaft sleeve 1529 may be threaded to receive a nut (not shown) or other fastener to hold the mounting sleeve 1339 in position within the wall of the tank. The tank shoulder 1523 also includes a full flush stop 1533 and a quick flush stop 1536 to limit the rotation of the handle lever 1333 during operation.

Figure 12D:
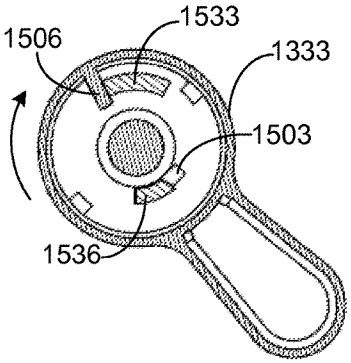
Figure 12C:
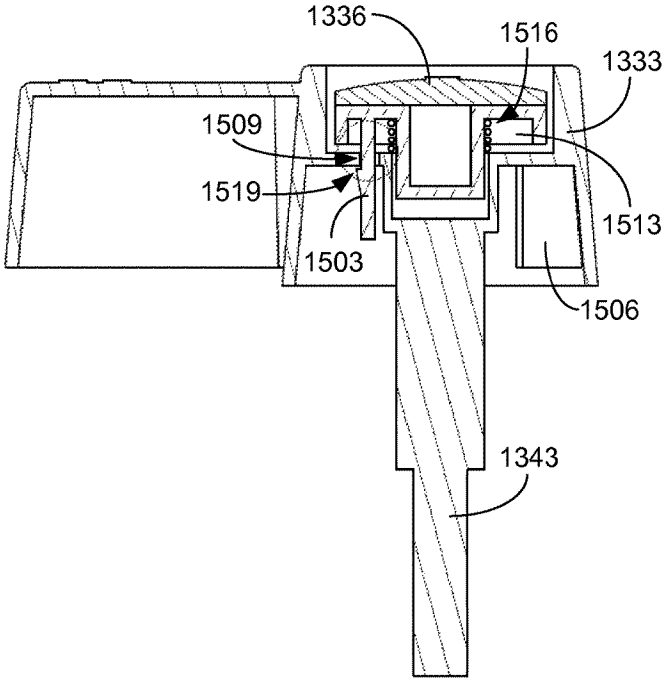

FIG. 12B is a cutaway view of the handle lever 1333 and handle button 1336. Handle button 1336 includes a quick flush tab 1503 and handle lever 1333 includes a full flush tab 1506 and an opening 1509. When handle button 1336 is inserted into button recess 1513 of the handle lever 1333, the quick flush tab 1503 extends through opening 1509 into handle lever 1333. The handle button 1336 is held in an extended position, as depicted in FIG. 12B, by a spring 1516 and locking tabs that engage with corresponding slots along the sides of button recess 1513. This arrangement allows handle button 1336 to be depressed, as depicted in FIG. 12C, further extending the quick flush tab 1503 into handle lever 1333. If handle button 1336 is sufficiently depressed, latch 1519 engages with handle lever 1333 to hold handle button 1336 is position until disengaged.

During operation of the dual flush assembly 103 (FIG. 1), positioning of the handle button 1336 determines the extent to which the handle lever 1333 can be rotated, thus controlling which of the dual flush modes is initiated. When the handle button 1336 is in the extended position as depicted in FIG. 12B, handle lever 1333 may be fully rotated to initiate the "full flush" mode of the dual flush assembly 103. Full flush tab 1506 engages full flush stop 1533 when handle lever 1333 is fully rotated, while quick flush tab 1503 does not engage quick flush stop 1536 as illustrated in FIG. 12D. FIG. 12E illustrates the relationship between the handle button 1336 and the mounting sleeve 1339. When the handle button 1336 is in the extended position, the quick flush tab 1503 passes by the quick flush stop 1536 as the handle lever 1333 is rotated.

Initiation of the "quick flush" mode of the dual flush assembly 103 is performed by depressing handle button 1336 and rotating handle lever 1333. Depressing handle button 1336 engages latch 1519 with handle lever 1333 to hold the handle button 1336 in a depressed position while the handle lever 1333 is rotated. FIG. 12F illustrates the relationship between the handle button 1336 and the mounting sleeve 1339 with the handle button in the depressed position. With handle button 1336 depressed, the quick flush tab 1503 is sufficiently extended to engage with quick flush stop 1536 when the handle lever 1333 is rotated as illustrated in FIG. 12G. Engagement of the quick flush tab 1503 with quick flush stop 1536 prevents further rotation of the handle lever 1333 to prevent rotation past the intermediate "quick flush" position.

With reference to FIGS. 12E-12G, the quick flush stop 1536 may include a tapered section 1539 that contacts the quick flush tab 1503 as the handle lever 1333 is rotated with the handle button 1336 depressed. As the handle lever 1333 is rotated, the tapered section 1539 of the quick flush stop 1536 forces the quick flush tab 1503 to prevent further rotation of the handle lever 1333. When further rotation of the handle lever 1333 is stopped by the quick flush stop 1536, the quick flush tab 1503 is released from engagement with the handle lever 1333. With latch 1519 disengaged, the handle button 1336 is allowed to return to the extended position under the force provided by spring 1516.

With reference back to FIG. 1, shown is a dual flush toilet system 100 including a dual flush assembly 103 and a push activation assembly 106 to initiate operation of the dual flush assembly 103 in one of the dual flush modes: quick flush for liquids and full flush for solids. In the embodiment of FIG. 1, the push activation assembly 106 includes a push button assembly 109 that is detachably connected to a push actuation control box 113. The push actuation control box 113 is in communication with the dual flush assembly 103 through a cable assembly 116, which is directly connected to the push actuation control box 113 and the body of the dual flush assembly 103.

Figure 13A:
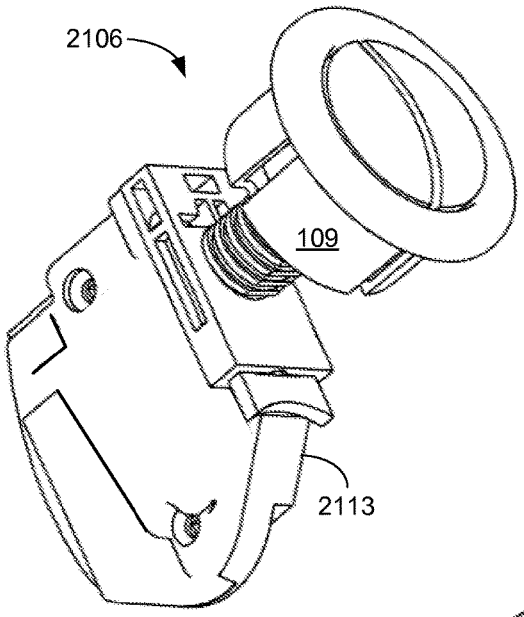
FIGS. 13A-13B are drawings of activation assemblies for use in the dual flush toilet system of FIG. 1 according to various embodiments of the disclosure.
Figure 13B:
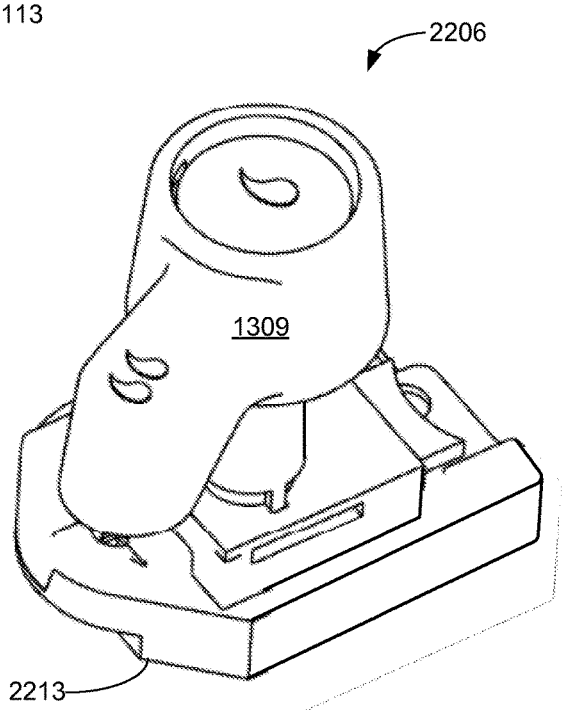

With reference to FIGS. 13A-13B and 10C, shown are activation assemblies that may be used in the dual flush toilet system 100 of FIG. 1 according to various embodiments of the disclosure. FIG. 13A illustrates an exemplary push activation assembly 2106 that includes a push button assembly 109 connected to a push actuation control box 2113. FIG. 13B illustrates an exemplary rotational activation assembly 2206 that includes a rotary handle assembly 1309 connected to a rotational actuation control box 2213. In the embodiment of FIG. 10C, a dual-input activation assembly 1306 allows for use of a push button assembly 109 and/or a rotational lever assembly 1309, which are connected to a dual-input actuation control box 1313. In some embodiments, the push button assembly 109 and the rotary handle assembly 1309 may be detachably connected to the corresponding actuation control box 2113, 2213, and 1313.

Referring now to FIG. 10D, shown is an exploded view of the dual-input activation assembly 1306. The dual-input actuation control box 1313 includes a cable anchor 1323 that detachably connects one end of a cable 229 of cable assembly 116 (see e.g., FIGS. 11A-11G). In the embodiment of FIG. 10D, the cable anchor 1323 is constrained within the dual-input actuation control box 1313 by a linear guide path 1326. In some embodiment, the dual-input actuation control box 1313 also includes a cam 1329 configured to translate activation motion of the push button assembly 109 and/or the rotary handle assembly 1309 into linear motion of the cable anchor 1323, and thus an attached cable 229 in cable assembly 116. The push activation assembly 2106 (FIG. 13A) and the rotational activation assembly 2206 (FIG. 13B) may also include a cable anchor 1323 and appropriate cam for translation of the activation motion of the push button assembly 109 and/or the rotary handle assembly 1309 into linear motion of the cable anchor 1323.

Figure 14A:
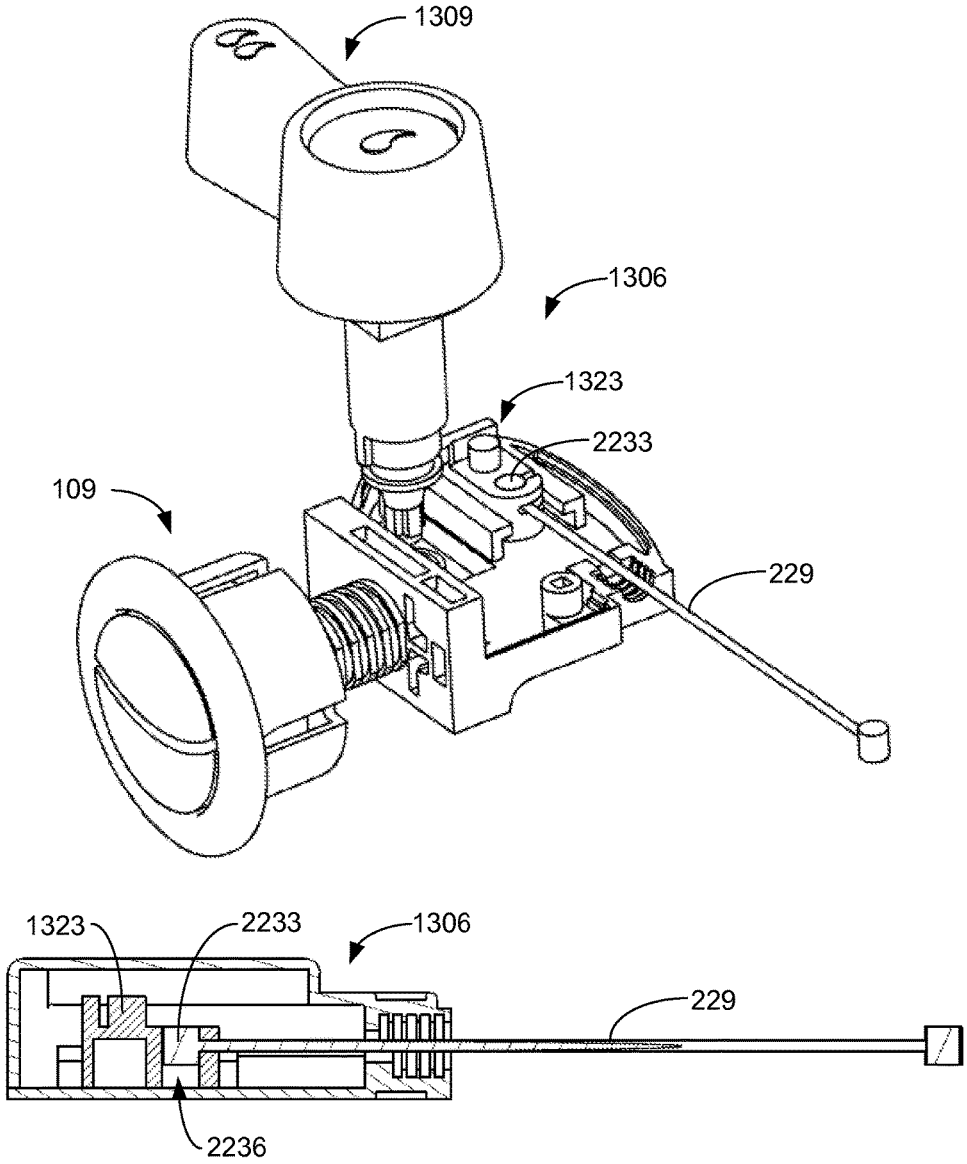
FIGS. 14A-14B are drawings that provide various views of examples of activation assemblies for use in the dual flush toilet system of FIG. 1 according to various embodiments of the disclosure.
Figure 14B:
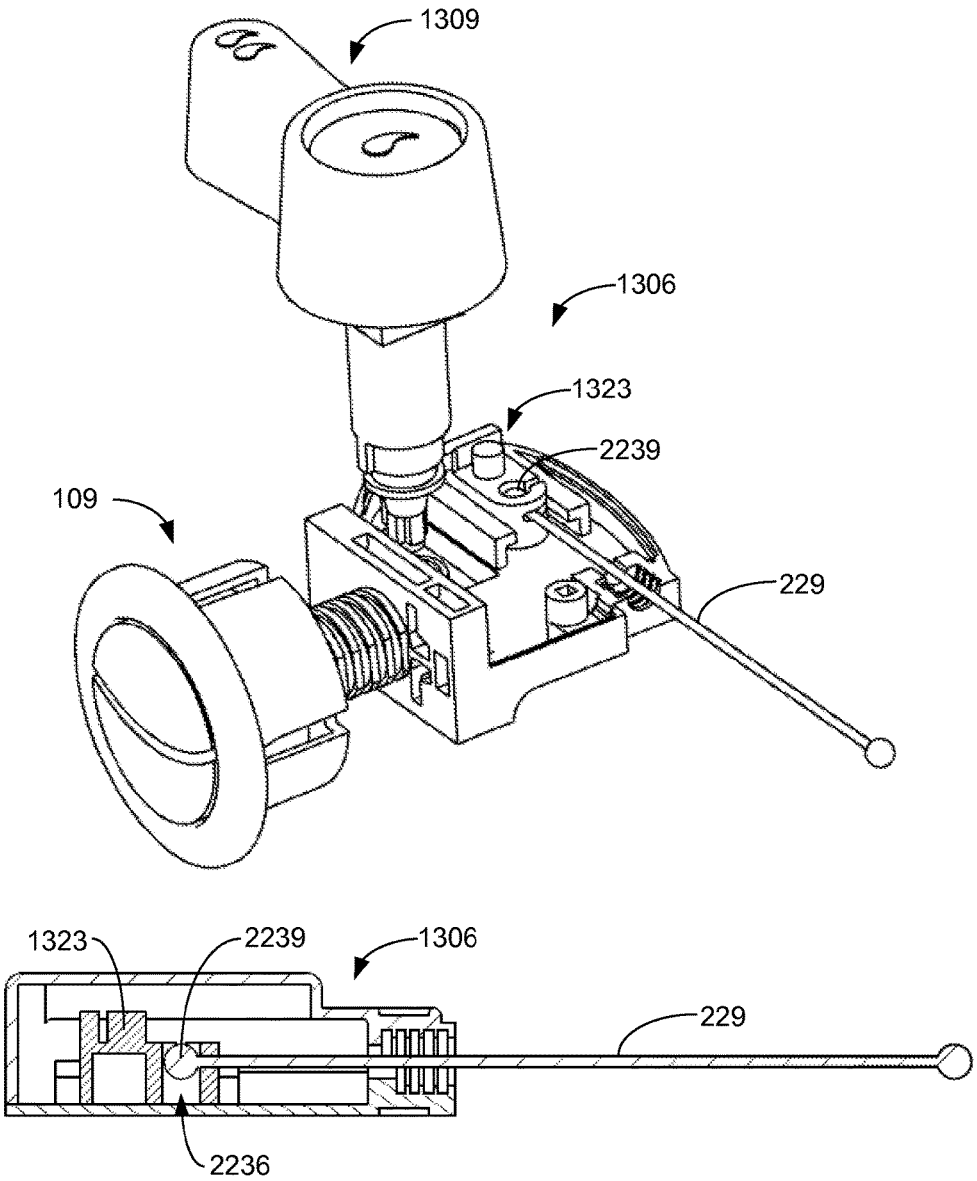

Referring next to FIGS. 14A-14B, shown are exemplary embodiments of connections of cable 229 of cable assembly 116 to the cable anchor 1323. In the embodiment of FIG. 14A, a cylindrical anchor point 2233 is attached to the end of the cable 229. The cylindrical anchor point 2233 fits within anchor opening 2236 of the cable anchor 1323, detachably connecting the end of cable 229 to the cable anchor 1323. In contrast, the exemplary embodiment of FIG. 14B includes a spherical anchor point 2239 attached to the end of the cable 2296. The spherical anchor point 2239 also fits within anchor opening 2236, detachably connecting the end of cable 229 to the cable anchor 1323. The spherical anchor point 2239 also provides an additional advantage of, if the cable 229 is twisted, the spherical anchor point 2239 may spin or rotate within anchor opening 2236 to eliminate torsional forces within the cable assembly 116. Anchor points may be included on one or both ends of cable 229.

Next, operation of exemplary activation assemblies 2106 (FIG. 13A), 2206 (FIG. 13B), and 1306 (FIG. 10C) is discussed with reference to the dual-input activation assembly 1306 as depicted in FIGS. 11A-11G. While the operation is discussed in terms of the dual-input activation assembly 1306, it can be understood that FIGS. 11A, 11D, and 11F are equally applicable to the push activation assembly 2106 (FIG. 13A) and FIGS. 11B, 11E, and 11G are equally applicable to the rotational activation assembly 2206 (FIG. 13B).

FIG. 11A illustrates dual-input activation assembly 1306 connected to a push button assembly 109. The push button assembly 109 includes a first button for activation of a quick flush mode with a reduced amount of water usage and a second button for activation of the full flush mode using the standard amount of water. FIG. 11A depicts the actuation control box 1313 in a neutral position without either the first button for activation of the quick flush mode or the second button for activation of the full flush mode depressed. In the neutral position, the cable anchor 1323 is in a neutral position in the linear guide path 1326 with cable 229 retracted in cable assembly 116.

Similarly, FIG. 11B illustrates the dual-input activation assembly 1306 connected to a rotary handle assembly 1309 (FIG. 10B). In the embodiment of FIG. 11B, the actuation control box 1313 is in a neutral position with the handle lever 1333 of the rotary handle assembly 1309 is in a horizontal position. As in FIG. 11A, the cable anchor 1323 is in a neutral position in the linear guide path 1326 with cable 229 retracted in cable assembly 116.

Referring next to FIGS. 11D and 11F, depressing one of the buttons of the push button assembly 109 extends a plunger 219 from the end of the push button assembly 109 into the actuation control box 1313. In the exemplary embodiments of FIGS. 11D and 11F, as the plunger 219 extends, the plunger 219 causes cam 1329 to rotate. The force provided through the plunger 219 is transferred through cam 1329 to the cable anchor 1323, producing movement of the cable anchor 1323 in the linear guide path 1326. As the cable anchor 1323 moves along the linear guide path 1326, the cable 229 is extracted from the cable assembly 116. As illustrated in FIG. 11D, depressing the first quick flush button extends the plunger 219 from the push button assembly 109 to an intermediate quick flush position. Rotation of cam 1329 causes the cable anchor 1323 to move to a corresponding intermediate position along the linear guide path 1326. As illustrated in FIG. 11F, depressing the second full flush button fully extends the plunger 219 from the push button assembly 109 causing the cable anchor 1323 to move to a corresponding full extension position along the linear guide path 1326. Releasing the buttons of the push button assembly 109 allows the cable 229 to retract into the cable assembly 116, returning the cable anchor 1323 to the neutral position of FIG. 11A.

Counter clockwise rotation of the rotary handle assembly 1309 produces a similar result. The torque transferred from the rotary handle assembly 1309 to the cam 1329 is exerted on the cable anchor 1323. As illustrated in FIG. 11E, rotating the rotary handle assembly 1309 to an intermediate quick flush position causes the cable anchor 1323 to move to a corresponding intermediate position along the linear guide path 1326. As the cable anchor 1323 moves along the linear guide path 1326, the cable 229 is extracted from the cable assembly 116. As illustrated in FIG. 11G, further rotation of the rotary handle assembly 1309 to a full flush position causes the cable anchor 1323 to move to a corresponding full extension position along the linear guide path 1326. Releasing the rotary handle assembly 1309 allows the cable 229 to retract into the cable assembly 116, returning the cable anchor 1323 to the neutral position of FIG. 11B.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A push button converter assembly for a dual flush toilet system, comprising:

a push button assembly; and a transfer box configured to detachably connect to an actuation control box of the dual flush toilet system, the transfer box configured to translate a linear motion of the push button assembly into a rotational motion accepted by the actuation control box to initiate a flush mode of the dual flush toilet system.

2. The push button converter assembly of claim 1, wherein the push button assembly is configured to detachably connect to the transfer box.

3. The push button converter assembly of claim 1, wherein the transfer box comprises:

a linkage assembly in communication with the push button assembly; and an interconnection shaft connected to the linkage assembly, the interconnection shaft in communication with the actuation control box;

the linkage assembly configured to translate linear motion of the push button assembly into rotational motion of the interconnection shaft that is accepted by the actuation control box.

4. The push button converter assembly of claim 1, wherein the push button assembly comprises:

a plunger;

a first button in communication with the plunger, the first button configured to extend the plunger to a first position when the first button is depressed, and a second button in communication with the plunger, the second button configured to extend the plunger to a second position when the first button is depressed.

5. The push button converter assembly of claim 4, wherein a quick flush of the dual flush toilet system is initiated when the first button is depressed and a full flush of the dual flush toilet system is initiated when the second button is depressed.

6. A method comprising the steps of:

disconnecting an existing push button handle from an actuation control box of a dual flush toilet system;

connecting a transfer box to the actuation control box;

connecting a handle assembly to the transfer box.

7. The method of claim 6, further comprising the steps of:

removing the existing push button handle from the tank of the toilet; and installing the handle assembly in the tank of the toilet before connecting the transfer box.

8. A method comprising the steps of:

disconnecting an existing lever handle from an actuation control box of a dual flush toilet system;

connecting a transfer box to the actuation control box;

connecting a push button assembly to the transfer box.

9. An activation control box for a dual flush toilet system, comprising:

a cable anchor comprising a breakaway shoulder and a translation pin; and an input cam configured to exert a breakaway force on the breakaway shoulder during initial rotation of the input cam and a subsequent translation force on the translation pin during subsequent rotation of the input cam.

10. The activation control box of claim 9, wherein the input cam comprises an anchor arm including a breakaway point at a first distance from a rotational axis of the input cam and a translation surface at a second distance from the rotational axis, the second distance greater than the first distance.

11. The activation control box of claim 10, wherein the anchor arm is configured to engage the breakaway shoulder at the breakaway point during the initial rotation of the input cam without engaging the translation pin, and wherein the anchor arm is further configured to engage the translation pin along the translation surface during subsequent rotation of the input cam without engaging the breakaway shoulder.

12. The activation control box of claim 9, wherein the input cam is further configured to engage with an activation control assembly.

13. The activation control box of claim 12, wherein the activation control assembly is a push button assembly.

14. The activation control box of claim 13, wherein the input cam includes a plunger arm that engages with the push button assembly.

15. An actuation control box for a dual flush toilet system, comprising:

a cable anchor; and a cable including a spherical anchor point connected to the cable anchor, wherein the cable is detachable from the cable anchor when the cable is at a first angle relative to the cable anchor and fastened to the cable anchor when the cable is at a second angle relative to the cable anchor.

16. The actuation control box of claim 15, further comprising a cam configured to translate the activation motion of an activation assembly into linear motion of the cable anchor.

17. The actuation control box of claim 16, wherein the activation assembly is a push button assembly.

* * * * *